US009222210B2

(12) United States Patent
Lee et al.

(10) Patent No.: US 9,222,210 B2
(45) Date of Patent: Dec. 29, 2015

(54) DRUM WASHING MACHINE AND WASHING METHOD THEREOF

(75) Inventors: Jong Ho Lee, Yongin-si (KR); Kyu Sun Lee, Seongnam-si (KR); Bo Kyung Lee, Seoul (KR); Jung Soo Lim, Hwaseong-si (KR); Byoung Yull Yang, Hwaseong-si (KR); Gyu Dong Jeon, Incheon (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 1028 days.

(21) Appl. No.: 13/341,270

(22) Filed: Dec. 30, 2011

(65) Prior Publication Data

US 2013/0145562 A1 Jun. 13, 2013

(30) Foreign Application Priority Data

Dec. 7, 2011 (KR) ..... 10-2011-0130040

(51) Int. Cl.
*D06F 39/08* (2006.01)
*D06F 37/26* (2006.01)

(52) U.S. Cl.
CPC ..... *D06F 39/088* (2013.01); *D06F 37/266* (2013.01)

(58) Field of Classification Search
CPC ..... D06F 39/088; D06F 37/266
See application file for complete search history.

(56) References Cited

U.S. PATENT DOCUMENTS

2005/0028298 A1* 2/2005 Kim et al. ..... 8/159
2005/0034488 A1* 2/2005 Oh et al. ..... 68/5 C
2006/0108454 A1 5/2006 Eichholz
2007/0079637 A1* 4/2007 Song ..... 68/17 R
2007/0107138 A1* 5/2007 Bernardino et al. ..... 8/158
2008/0072631 A1* 3/2008 Je et al. ..... 68/17 R
2008/0314092 A1* 12/2008 Finke et al. ..... 68/5 C
2009/0249838 A1* 10/2009 Kim et al. ..... 68/58
2009/0249840 A1* 10/2009 Jo et al. ..... 68/5 C
2010/0236001 A1* 9/2010 Lee et al. ..... 8/159
2010/0251784 A1* 10/2010 Lee et al. ..... 68/200
2011/0088172 A1* 4/2011 Im et al. ..... 8/137
2011/0099727 A1* 5/2011 Kim et al. ..... 8/137
2011/0146004 A1* 6/2011 Kim et al. ..... 8/137

FOREIGN PATENT DOCUMENTS

EP 2006436 A2 12/2008
EP 2108731 A2 10/2009
JP 2002282587 A * 10/2002 ..... D06F 39/08

OTHER PUBLICATIONS

Machine translation of JP 2002282587 A, no date.*
Extended European Search Report mailed Aug. 30, 2013 in related European Application No. 12195572.8.
Partial European Search Report issued May 6, 2013 in corresponding European Application No. 12195572.8.

* cited by examiner

*Primary Examiner* — Joseph L Perrin
(74) *Attorney, Agent, or Firm* — Staas & Halsey LLP

(57) ABSTRACT

A drum washing machine and washing method are provided. The washing machine directly sprays water to laundry inside the drum through a nozzle unit. The method includes passing some water through a detergent container and directly spraying some water to the inside of a drum through a nozzle unit such that a high concentration of detergent bubbles is generated while applying a force to the laundry. The washing machine includes a cabinet, a tub inside the cabinet, a drum inside the tub, a door on the cabinet, a diaphragm, and a nozzle unit installed so interference with the door is avoided and to receive water directly from an external source to spray water inside the drum during a washing cycle and a rinsing cycle. The nozzle unit adjusts water jetting according to a displacement of an actuator installed inside the nozzle unit.

12 Claims, 25 Drawing Sheets

100(120)

DRUM WASHING MACHINE AND WASHING METHOD THEREOF

CROSS-REFERENCE TO RELATED APPLICATION

This application claims the benefit of Korean Patent Application No. 2011-130040, filed on Dec. 7, 2011 in the Korean Intellectual Property Office, the disclosure of which is incorporated herein by reference.

BACKGROUND

1. Field

Embodiments of the present disclosure relate to a drum washing machine and a washing method thereof.

2. Description of the Related Art

A drum washing machine is a machine configured to wash laundry, such as clothing, by use of electricity. In general, the drum washing machine includes a tub to accommodate washing water, a drum rotatably installed inside the tub, a motor to rotate the drum, a door installed at an opening of the tub to open/close the opening, and a diaphragm installed between the tub and the door to seal the tub and the door.

A washing operation is performed by supplying water to the drum, accommodating laundry through a water-supply valve, and by rotating the drum.

Water supplied through the water-supply valve is mixed with detergent of a detergent container by passing through the detergent container and then is provided to the inside of the drum. However, most of the water supplied from the water-supply valve is provided to the inside of the drum, so that detergent bubbles with a high concentration are not easily generated, causing a difficulty in enhancing the washing efficiency.

In general, a water-supply apparatus having a nozzle uses a circulation pump, and adsorption of surfactant existing in washing water or rinsing water may lower the rinsing efficiency.

In addition, such a nozzle is configured to spray water through an open front portion of the nozzle without adjusting a jetting angle, and the sprayed water may be reintroduced to the opening and thus the efficiency of spraying water is lowered.

SUMMARY

Therefore, it is an aspect of the present disclosure to provide a drum washing machine capable of receiving water from an external water-supply source and directly spraying the received water to the laundry inside the drum through a nozzle unit.

It is another aspect of the present disclosure to provide a drum washing machine capable of implementing various types of water-supply by use of various nozzle units.

It is another aspect of the present disclosure to provide a washing method of a drum washing machine capable of passing some of the water, which is supplied through a water valve, through a detergent container and of directly spraying the remaining to the inside a drum through a nozzle unit such that a high concentration of detergent bubbles is generated by some of the water passing through the detergent container while directly applying a physical force to the laundry through the nozzle unit.

It is another aspect of the present disclosure to provide a washing method of a drum washing machine capable of enhancing the rinsing efficiency by directly spraying water to the laundry contained inside a drum through a nozzle unit in a spinning cycle and a rinsing cycle.

Additional aspects of the disclosure will be set forth in part in the description which follows and, in part, will be obvious from the description, or may be learned by practice of the disclosure.

In accordance with one aspect of the present disclosure, a drum includes a cabinet, a tub, a drum, a door, a diaphragm and a nozzle unit. The cabinet forms an external appearance. The tub is provided inside the cabinet to accommodate to washing water. The drum is rotatably installed inside the tub. The door is installed on the cabinet to open and close an opening formed in the tub. The diaphragm is installed between the tub and the door to seal a space between the tub and the door. The nozzle unit is installed at an upper portion of the diaphragm such that interference with the door is avoided and configured to receive water directly from an external water-supply source, which is provided outside the cabinet, and to spray water to inside the drum during a washing cycle and a rinsing cycle. The nozzle unit is a variable-type nozzle unit that can adjust a water jetting type of the nozzle unit according to a displacement of a linear actuator that is installed inside the nozzle unit and moves back and forth.

The variable-type nozzle unit is installed at an upper-middle portion of the diaphragm and adjusts the water jetting type according to an operation time of the linear actuator.

The variable-type nozzle unit includes a body part, which is provided on a front surface thereof with a jetting exit to spray water, a water-supply pipe connection part connected to the body part to receive water directly from the external water-supply source, a spring installed inside the body part to apply an elastic force to the linear actuator, which has moved forward, such that the linear actuator move backward, an O-ring which is installed inside the body part to prevent leakage of water supplied through the water-supply pipe connection part, and a nozzle which is installed on a front surface of the linear actuator and moves back and forth by the linear actuator.

A nozzle head formed on a front surface of the nozzle partially protrudes beyond the jetting exit, and the nozzle head includes a cylindrical middle portion, a front portion, which extends from a front end of the cylindrical middle portion and has an inner diameter decreasing in size as the inner diameter reaches forward, and a rear portion, which extends from a rear end of the cylindrical middle portion and has an inner diameter decreasing in size as the inner diameter reaches backward.

When the linear actuator is in a non-operation state, the front portion of the nozzle head is disposed at the jetting exit such that water, which is jet through the jetting exit, is guided by a shape of the front portion and is sprayed toward a center of the drum washing machine in a concentrated jet.

The concentrated jet of the variable-type nozzle unit enables water to be directly sprayed to laundry inside the drum with a high pressure such that dirt is easily removed from the laundry.

When the linear actuator moves forward by a small amount of distance, the cylindrical middle portion of the nozzle head is disposed at the jetting exit such that water, which is jet through the jetting exit, is guided by a shape of the cylindrical middle portion and is sprayed in a horizontal jet.

The horizontal jet of the variable-type nozzle unit enables water to be sprayed laundry inside the drum such that moistening is easily performed and enables a physical force to be applied to the laundry such that dirt is easily removed from the laundry.

When the linear actuator moves forward by a maximum amount of distance, the rear portion of the nozzle head is disposed at the jetting exit such that water, which is jet through the jetting exit, is guided by a shape of the rear portion and is sprayed in a dispersed jet.

The dispersed jet of the variable-type nozzle unit enables laundry inside the drum to be easily moist and enables water to be sprayed to the laundry inside the drum in a dehydration cycle such that a rinsing performance for the laundry is enhanced.

The variable-type nozzle unit is connected to the external water-supply source for both hot water and cold water through a water-supply valve and wherein a flow path conversion valve is installed between the water-supply valve and the variable-type nozzle unit to spray hot water and cold water selectively.

The water-supply valve is implemented using a four-way valve such that a first water-supply pipe connected to the water-supply valve includes three water-supply lines, which are connected to a detergent container to be used for bleaching, preliminary washing, and main washing, respectively, and a second water-supply pipe connected to the water-supply valve includes one supply line connected to the variable nozzle unit.

In accordance with another aspect of the present disclosure, a drum washing machine includes a cabinet, a tub, a drum, a door, a diaphragm and a plurality of nozzle units. The cabinet forms an external appearance. The tub is provided inside the cabinet to accommodate to washing water. The drum is rotatably installed inside the tub. The door is installed on the cabinet to open and close an opening formed in the tub. The diaphragm is installed between the tub and the door to seal a space between the tub and the door. The plurality of nozzle units are installed at an upper portion of the diaphragm above a middle portion of the diaphragm in a tangential direction of the diaphragm such that interference with the door is avoided and are configured to receive water directly from a water-supply source, which is provided outside the cabinet, and to spray the received to inside the drum. The nozzle unit is a slit nozzle unit that has a jetting exit provided in a curved shape slit in which a middle portion of the jetting exit has an interval smaller than intervals of end portions of the jetting exit.

A longitudinal size of an inner passage of the slit nozzle unit is decreasing toward the jetting exit such that flow rate of water, which is supplied through the slit nozzle unit, is increased as the water approaches to the jetting exit, and a transverse size of the inner passage of the slit nozzle unit is increasing toward the jetting exit such that the supplied water is widely sprayed in a dispersed jet through the jetting exit.

The jetting exit is provided on the slit nozzle unit, which is installed on the diaphragm in the tangential direction, to form an angle of ±20 degrees with respect to the slit nozzle unit such that interference with the door is avoided.

If the slit nozzle unit is installed at an upper-left portion of the diaphragm, the jetting exit is provided to form an angle of 20 degrees in a counter-clockwise direction with respect to the tangential direction of the diaphragm; and if the slit nozzle unit is installed at an upper-right portion of the diaphragm, the jetting exit is provided to form an angle of 20 degrees in a clockwise direction with respect to the tangential direction of the diaphragm.

If the slit nozzle unit is installed at an upper-middle portion of the diaphragm, water passing through the jetting exit is sprayed toward the inside the drum with a jetting angle of 170 degrees or below with respect to a perpendicular line to an installation point, in which the slit nozzle unit is installed, such that interference with the door is avoided.

If the slit nozzle unit is installed at the upper-left portion and the upper-right portion of the diaphragm, water through the jetting exit is sprayed toward the inside the drum with a jetting angle of 150 degrees or below with respect to a perpendicular line to an installation point, in which the slit nozzle unit is installed, such that interference with the door is avoided.

If the slit nozzle unit is installed at a middle left portion and a middle right portion of the diaphragm, water through the jetting exit is sprayed toward the inside the drum with a jetting angle of 135 degrees or below with respect to a perpendicular line to an installation point, in which the slit nozzle unit is installed, such that interference with the door is avoided.

The plurality of slit nozzle units is connected to the external water-supply source for both hot water and cold water through a water-supply valve; and wherein a flow path conversion valve is installed between the water-supply valve and each of the plurality of slit nozzle units to spray hot water and cold water selectively.

The water-supply valve is implemented using a four-way valve such that a first water-supply pipe connected to the water-supply valve includes three water-supply lines, which are connected to a detergent container to be used for bleaching, preliminary washing and main washing, respectively, and a second water-supply pipe connected to the water-supply valve includes one supply line connected to the plurality of slit nozzle units, and wherein hot water or cold water is selected through the flow path conversion valve and supplied to the plurality of slit nozzle units.

The water-supply valve is implemented using a four-way valve such that a first water-supply pipe connected to the water-supply valve includes three water-supply lines, which are connected to a detergent container to be used for bleaching, preliminary washing, and main washing, respectively, and a second water-supply pipe connected to the water-supply valve includes one supply line connected to the plurality of slit nozzle units, and wherein the flow path conversion valve, which is configured to select the hot water and cold water, and a four-way valve, which is configured to supply water passing through the flow path conversion valve, to the plurality of slit nozzle units, are installed on the one water-supply line that is connected to the plurality of slit nozzle units.

The drum rotates in a counter-clockwise direction, water is sprayed through the slit nozzle unit installed at the upper-left portion of the diaphragm among the plurality of slit nozzle units, and if the drum rotates in a clockwise direction, water is sprayed through the slit nozzle unit installed at the upper-right portion of the diaphragm among the plurality of slit nozzle units such that the water is sprayed to a falling section of the laundry inside the drum, so that the load of a motor is minimized and energy consumption is reduced.

If the drum rotates in a counter-clockwise direction, water is sprayed through the slit nozzle unit installed at the upper-right portion of the diaphragm among the plurality of slit nozzle units, and if the drum rotates in a clockwise direction, water is sprayed through the slit nozzle unit installed at the upper-left portion of the diaphragm among the plurality of slit nozzle units such that the water is sprayed to a rising section of the laundry inside the drum, so that additional physical force is applied to the laundry and a washing cycle and a rinsing cycle is efficiently performed.

In accordance with another aspect of the present disclosure, a drum washing machine includes a cabinet, a tub, a drum, a door, a diaphragm, and a plurality of nozzle units. The cabinet forms an external appearance. The tub is provided inside the cabinet to accommodate to washing water. The drum is rotatably installed inside the tub. The door is installed on the cabinet to open and close an opening formed in the tub. The diaphragm is installed between the tub and the door to seal a space between the tub and the door. The plurality of nozzle units are installed at an upper portion of the diaphragm above a middle portion of the diaphragm in a tangential direction of the diaphragm such that interference with the door is avoided and are configured to receive water directly from a water-supply source, which is provided outside the cabinet, and to spray water to inside of the drum. The nozzle unit is an open-type orifice nozzle unit that includes a first passage to receive water and a second passage allowing water passing through the first passage to be sprayed through a jetting exit and wherein the first passage has an inner diameter decreasing in size from an inlet of the first passage, which is configured to receive water, to an outlet of the first passage connected to the second passage such that flow rate of water is increased while passing through the first passage.

The second passage has an inner diameter increasing in size from a connection part with the first passage to the jetting exit such that the water, flow rate of which has been increased while passing through the first passage, is widely sprayed in dispersed jet through the jetting exit.

The open-type orifice nozzle unit is installed at an upper-middle portion of the diaphragm, water passing through the jetting exit is sprayed toward the inside the drum with a jetting angle of 170 degrees or below with respect to a perpendicular line to an installation point, in which the slit nozzle unit is installed, such that interference with the door is avoided.

If the open-type orifice nozzle unit is installed at an upper-left portion and an upper-right portion of the diaphragm, water through the jetting exit is sprayed toward the inside the drum with a jetting angle of 150 degrees or below with respect to a perpendicular line to an installation point, in which the slit nozzle unit is installed, such that interference with the door is avoided.

If the open-type orifice nozzle unit is installed at a middle left portion and a middle right portion of the diaphragm, water through the jetting exit is sprayed toward the inside the drum with a jetting angle of 135 degrees or below with respect to a perpendicular line to an installation point, in which the slit nozzle unit is installed, such that interference with the door is avoided.

The plurality of slit nozzle units is connected to the external water-supply source for both hot water and cold water through a water-supply valve and wherein a flow path conversion valve is installed between the water-supply valve and each of the plurality of slit nozzle units to spray hot water and cold water selectively.

The water-supply valve is implemented using a four-way valve such that a first water-supply pipe connected to the water-supply valve includes three water-supply lines, which are connected to a detergent container to be used for bleaching, preliminary washing, and main washing, respectively, and a second water-supply pipe connected to the water-supply valve includes one supply line connected to the plurality of slit nozzle units, and wherein hot water or cold water is selected through the a flow path conversion valve and supplied to the plurality of slit nozzle units.

The water-supply valve is implemented using a four-way valve such that a first water-supply pipe connected to the water-supply valve includes three water-supply lines, which are connected to a detergent container to be used for bleaching, preliminary washing, and main washing, respectively, and a second water-supply pipe connected to the water-supply valve includes one supply line connected to the plurality of slit nozzle units, and wherein the a flow path conversion valve, which is configured to select the hot water and cold water, and a four-way valve, which is configured to supply water passing through the a flow path conversion valve, to the plurality of slit nozzle units, are installed on the one water-supply line that is connected to the plurality of slit nozzle units.

If the drum rotates in a counter-clockwise direction, water is sprayed through the slit nozzle unit installed at the upper-left portion of the diaphragm among the plurality of slit nozzle units, and if the drum rotates in a clockwise direction, water is sprayed through the slit nozzle unit installed at the upper-right portion of the diaphragm among the plurality of slit nozzle units, so that the load of a motor is minimized and energy consumption is reduced.

If the drum rotates in a counter-clockwise direction, water is sprayed through the slit nozzle unit installed at the upper-right portion of the diaphragm among the plurality of slit nozzle units, and if the drum rotates in a clockwise direction, water is sprayed through the slit nozzle unit installed at the upper-left portion of the diaphragm among the plurality of slit nozzle units, so that additional physical force is applied to the laundry and a washing cycle and a rinsing cycle is efficiently performed.

In accordance with another aspect of the present disclosure, a washing method of a drum washing machine, which is configured to supply water through a water-supply valve connected to an external water-supply source and configured to switch off or on a divergence valve installed on the water-supply valve such that the water supplied through the water-supply valve is supplied to inside of a drum via a detergent container or is sprayed to inside the drum through a nozzle unit, is as follows. The water-supply valve is switched on and the divergence valve is switched off to supply water only to the detergent container such that water passing through the detergent container is supplied to the inside the drum and thus generates a concentrated bubbles of detergent. A washing cycle is performed by switching on the divergence valve such that water is directly sprayed to laundry inside the drum through the nozzle unit. Upon completion of the washing cycle, a drain pump is turned on to drain water inside the drum and then the water-supply valve and the divergence valve are switched on to spray water to the laundry through the nozzle unit such that a rinsing power is increased while draining water from inside the drum. The water-supply valve is switched off, upon completion of draining of the water from inside the drum, and then the water-supply valve and the divergence valve are switched on to spray water the laundry through the nozzle unit such that a rinsing power is increased while performing a hydration cycle. Upon completion of the hydration cycle, the water-supply valve and the divergence valve are switched on to spray water to the laundry through the nozzle unit while performing a rinsing cycle. Upon completion of the rinsing cycle, a hydration cycle and a rinsing cycle are alternately performed, thereby completing a laundry washing with a final hydration cycle.

The washing method further includes switching on the water-supply valve and the divergence valve to spray water to the laundry inside the drum in a surplus power rotation range of the drum happening after turning off a motor, which is configured to rotate the drum, to complete the dehydration cycle, thereby increasing the rinsing power.

The washing method further includes, after completion of the dehydration cycle, turning on the drain pump to drain waste water from the drum such that the rinsing cycle is performed.

The nozzle unit is provided in plural and the nozzle units are configured to sequentially spray water to the laundry.

Before the drum stops rotating in the final dehydration cycle, the divergence valve is repeatedly switched on and off while switching on the water-supply valve to adjust an amount of a jet of water passing through the nozzle unit, thereby cleaning the door.

As described above, since water is directly sprayed from an external water-supply source to the inside of a drum, wetting is effectively achieved, thereby reducing the operation time and the energy consumption and the water consumption.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
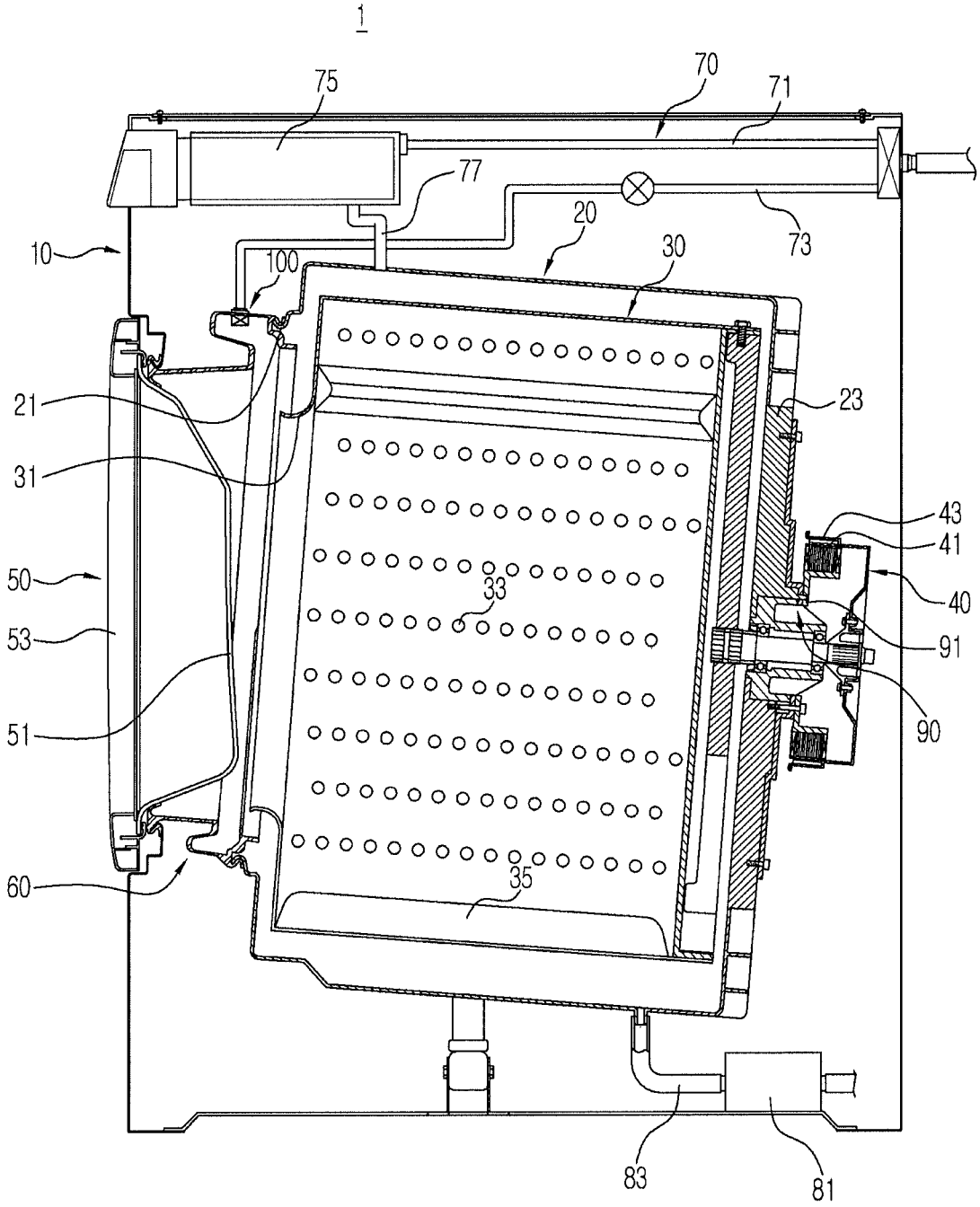
FIG. 1 is a cross-sectional view illustrating a drum washing machine according to an embodiment of the present disclosure.

Reference will now be made in detail to the embodiments of the present disclosure, examples of which are illustrated in the accompanying drawings, wherein like reference numerals refer to like elements throughout.

Referring to FIG. 1, a drum washing machine 1 includes a cabinet 10 forming an external appearance, a tub 20 provided to accommodate washing water in the cabinet 10, a drum 30 rotatably installed inside the tub 20, a motor 40 to drive the drum 30, a door 50 installed on a front surface of the cabinet 10 to open and close an opening 21 of the tub 20, a diaphragm 60 installed in the tub 20 and on the door 50 to seal a space between the tub 20 and the door 50, and a nozzle unit 100 that is installed on the diaphragm

60 to receive water from an external water-supply source (not shown) to directly spray the water received to the laundry inside the drum 30.

An opening 11 is formed on a front surface of the cabinet 10 that is opened and closed by the door 50 that is installed on the front surface of the cabinet 10.

The door 50 is provided with a door glass 51, which enables the inside of the drum 30 to be viewed, and a door frame 53 supporting the door glass 51.

Openings 21 and 31 are formed on the front surfaces of the tub 20 and the drum 30, respectively, to correspond to the opening of the cabinet 10. The openings 21 and 31 allow laundry to be inserted to the inside the drum 30 therethrough.

A water-supply pipe 70 is installed at an upper portion of the tub 20 to supply washing water to the tub 20. The water-supply pipe 70 includes a first water-supply pipe 71 and a second water-supply pipe 73. The first water-supply pipe 71 has one side connected to the external water-supply source, and the other side connected to a detergent container 75. The second water-supply pipe 73 has one side connected to the external water-supply source, and the other side connected to the nozzle unit 100.

The first water-supply pipe 71 includes three water-supply lines, and is connected to the detergent container 75. The second water-supply pipe 73 includes one water-supply line, and is connected to the nozzle unit 100.

The detergent container 75 is connected to the tub 20 through a connection pipe 77. Water supplied through the first water-supply pipe 71 passes through the detergent container 75, and then supplied to the inside the tub 20 together with detergent.

The nozzle unit 100 may be provided in plural and may be installed on the diaphragm 60. The nozzle unit 100 directly receives from the external water-supply source and directly spray the water received to the inside the drum 30.

A drain pump 81 and a drain pipe 83 are installed at a lower portion of the tub 20 to drain water inside the tub 30 to the outside the cabinet 10.

A plurality of through holes 33 are formed at the circumference of the drum 30. A plurality of lifters 35 is formed at an inner circumferential surface of the drum 30 such that laundry rises and falls during the rotation of the drum 30.

The motor 40 is mounted on a rear side wall 23, and includes a stator 41 fixed to the tub 20 and a rotor 43 rotatably disposed around the stator 41.

The rotor 43 rotates through an electromagnetic interaction with the stator 41, and transfers a rotary force to a driving shaft 45.

The driving shaft 45 transfers a rotary force of the motor 40 to the drum 30 and has one end connected to the drum 30 and the other end extending the rear side wall 23 of the tub 30 and coupled to the rotor 43.

A bearing housing 90 is installed on the rear side wall 23 to rotatably support the driving shaft 45. The bearing housing 90 includes an aluminum alloy. The bearing housing 90 may be inserted through the rear side wall 23 of the tub 20 during an injection molding of the tub 20.

Bearings 90 are installed between the bearing housing 90 and the driving shaft 45 to smoothly rotate the driving shaft 45.

The diaphragm 60 is installed between the tub 20 and the door 50. The diaphragm 60 is disposed between the opening of the cabinet 10 and the opening 21 of the tub 20 to form a passage along the opening 11 of the cabinet 10 to the opening 31 of the drum 30, and to prevent vibration from being transferred to the cabinet 10 during rotation of the drum 30.

In addition, a part of the diaphragm 60 is disposed between the door 50 and the cabinet 10 to prevent water of the tub 20 from leaking from the cabinet 10.

Hereinafter, following descriptions are made in detail in relation to the structure of the nozzle unit 100 for directly receiving water from the external water-supply source, and for directly spraying the received water to the laundry inside the drum 30, the configuration of the nozzle unit 100 implementing various types of water-supply, and a washing method capable of improving the rinsing performance of laundry by directly spraying water to the laundry inside the drum 30 through the nozzle unit 100 in a hydration cycle and a rinsing cycle.

Referring to FIG. 1, the nozzle unit 100 is installed on the diaphragm 60 to directly receive water from the external water-supply source and directly spray water to the laundry inside the drum 30.

The nozzle unit 100 includes a variable-type nozzle unit 110, a slit nozzle unit 120, and an open-type orifice nozzle unit 130. The variable-type nozzle unit 110 is configured to adjust a water jetting type. The slit nozzle unit 120 has a jetting exit 121 provided in the form of a slit. The open-type orifice nozzle unit 130 includes a first passage 131 to receive water, and a second passage 133 that allows the water passing through the first passage 131 to be sprayed through 135. The first passage 131 has an inner diameter decreasing in size from an inlet 131*a* of the first passage 131 to an outlet 131*b* connected to the second passage 133.

Figure 2:
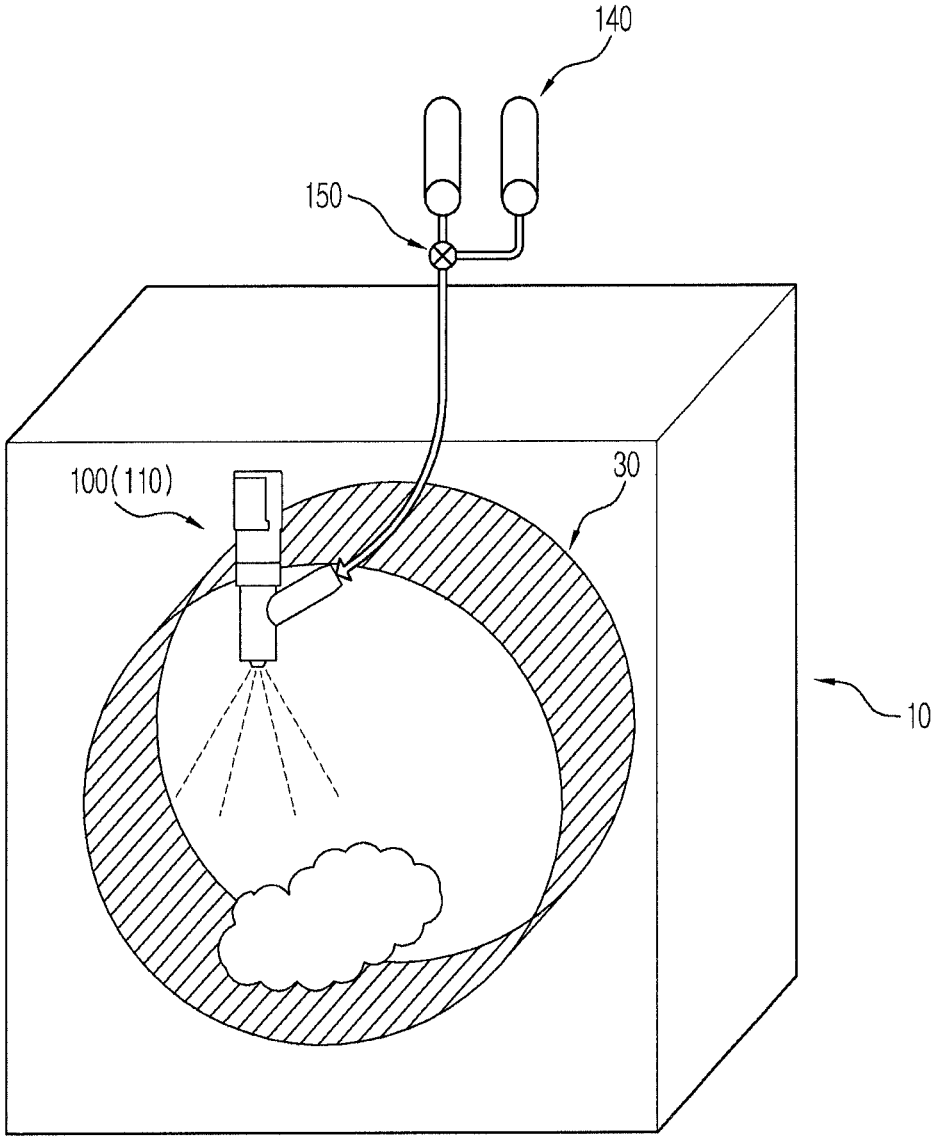
FIG. 2 is a schematic view illustrating the configuration in which water is supplied through a variable-type nozzle unit of the drum washing machine according to the embodiment of the present disclosure.
Figure 3:
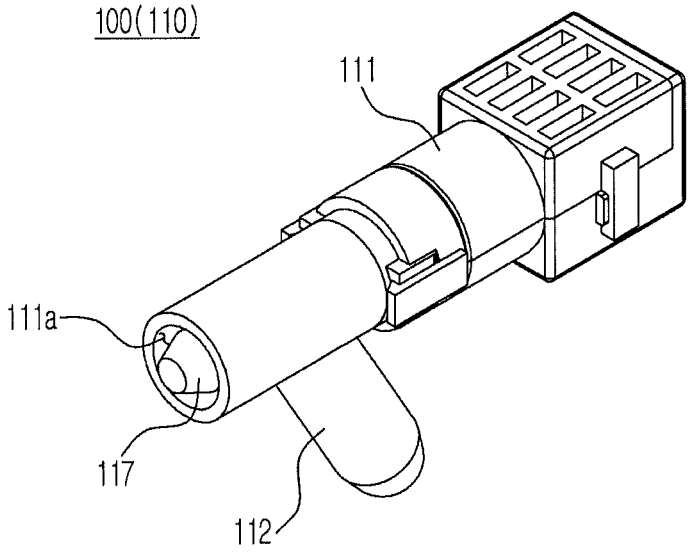
FIG. 3 is a perspective view illustrating a variable-type nozzle unit of the drum washing machine according to the embodiment of the present disclosure.

Referring to FIGS. 1 and 2, the variable-type nozzle unit 110 is installed on the diaphragm 60, which is installed between the tub 20 and the door 50 to seal a space between the tub 20 and the door 50.

The variable-type nozzle unit 110 is installed at an upper-middle portion of the diaphragm 60 to avoid interference with the door 50 when spraying water to the laundry in the drum 30. The variable-type nozzle unit 110 directly receives water from the external water-supply source and directly sprays the received water to the laundry in the drum 30 in a washing cycle and a rinsing cycle.

Referring to FIGS. 3 to 6, the variable-type nozzle unit 110 includes a body part 111, which is provided on a front surface thereof with a jetting exit 111*a* to spray water, a water-supply pipe connection part 112 connected to the body part 111 to directly receive water from the external water-supply source, a linear actuator 113 installed inside the body part 111 to move back and forth, a spring 114 installed inside the body part 111 to apply an elastic force to the linear actuator 113, which has moved forward, such that the linear actuator move backward, an O-ring 115 which is installed inside the body part 111 to prevent leakage of water supplied through the water-supply pipe connection part 112, and a nozzle 116 which is installed on a front surface of the linear actuator 113 and moves back and forth by the linear actuator 113.

A nozzle head 117 is formed on a front surface of the nozzle 116 while partially protruding beyond the jetting exit 111*a* formed in the body part 111. The nozzle head 117 includes a cylindrical middle portion 117*b*, a front portion 117*a*, which extends from a front end of the cylindrical middle portion 117*b* and has an inner diameter decreasing in size as the inner diameter reaches forward, and a rear portion 117*c*, which extends from a rear end of the cylindrical middle portion 117*b* and has an inner diameter decreasing in size as the inner diameter reaches backward.

The variable-type nozzle unit 110 adjusts the water jetting type based on the level of protrusion that varies with a back and forth movement of the nozzle installed on the front surface of the linear actuator as the linear actuator 113 installed inside the body part 111 moves back and forth.

In addition, the duration of a predetermined water jetting type is determined by the operation time of the linear actuator 113.

Hereinafter, various types of water jetting of the variable-type nozzle unit 110 are described.

Figure 4:
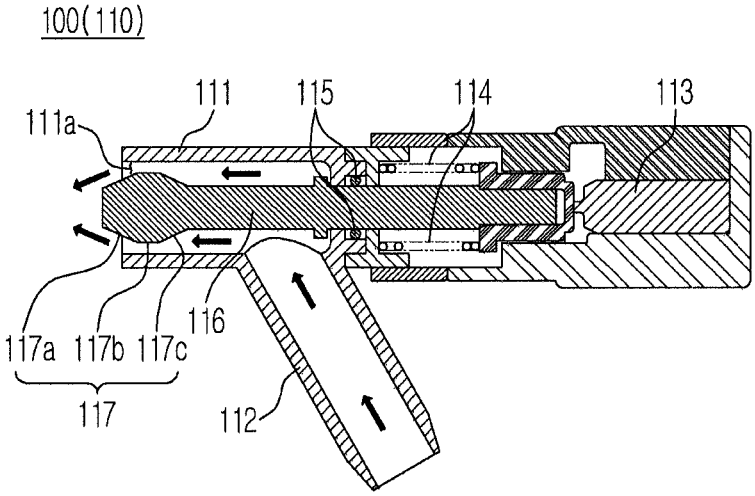
FIGS. 4 to 6 are views illustrating the operation of a variable-type nozzle unit of the drum type washing machine according to the embodiment of the present disclosure.

Referring to FIG. 4, if the linear actuator 113 is in a non-operation state, the front portion 117*a* of the nozzle head 117 is disposed at the jetting exit 111*a* of the body part 111 as the nozzle 116 connected to the linear actuator 113 remains still.

Since the front portion 117*a* of the nozzle head 117 disposed at the jetting exit 111*a* has an inner diameter that decreases forward, water jet through the jetting exit 111*a* is guided by the shape of the front portion 117*a* of the nozzle head 117 and is sprayed toward the center of the drum washing machine 1 in a concentrated jet.

Such a concentrated jet of the variable-type nozzle unit 110 enables water to be intensively sprayed to laundry with a high pressure, so that strong impact is applied to the laundry and thus dirt is easily removed from the laundry.

Figure 5:
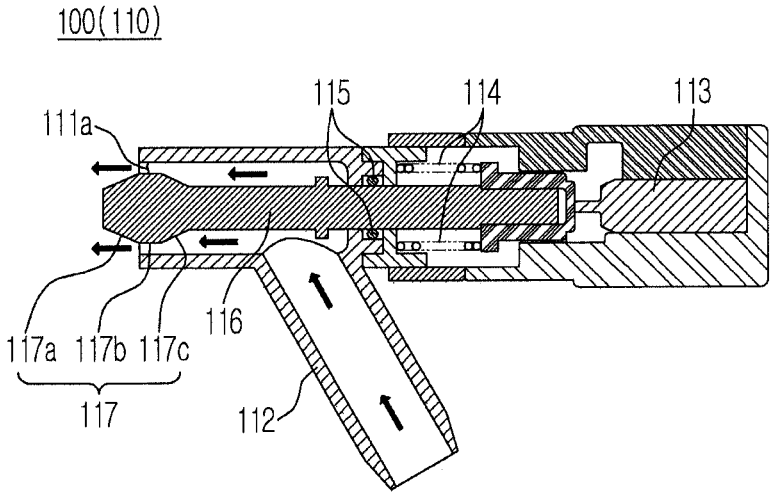

Referring to FIG. 5, if the linear actuator 113 moves forward by a small amount of distance, the cylindrical middle portion 117*b* of the nozzle head 117 is disposed at the jetting exit 111 as the nozzle 116 connected to the linear actuator 113 moves forward by a small amount of distance together with the linear actuator 113.

Since the cylindrical middle portion 117*b* of the nozzle head 117 disposed at the jetting exit 111*a* has an identical inner diameter, water jet through the jetting exit 111*a* is guided by the shape of the cylindrical middle portion 117*b* of the nozzle head 117 and is sprayed in a horizontal jet.

Such a horizontal jet of the variable-type nozzle unit 110 provides a lower flow rate than the concentrated jet of water, but enables water to be sprayed to a wider surface of laundry. Accordingly, dirt is easily removed from the laundry due to impact applied to the laundry while moistening.

Figure 6:
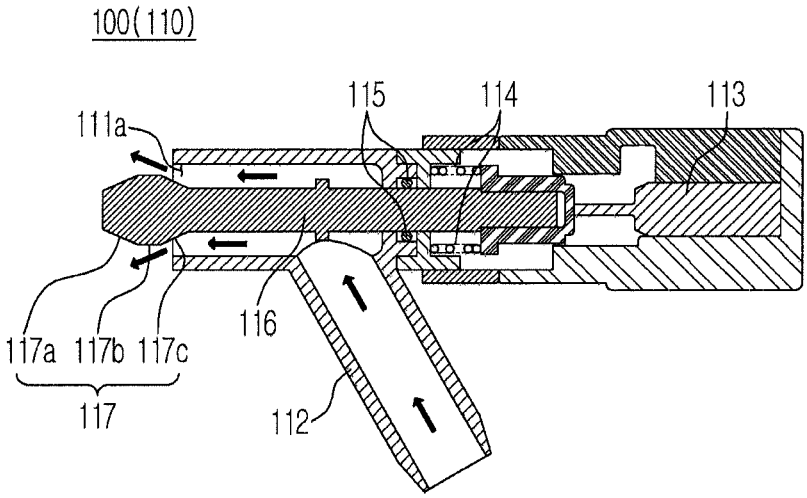

Referring to FIG. 6, if the linear actuator 113 moves forward by a large amount of distance, the rear portion 117*c* of the nozzle head 117 is disposed at the jetting exit 111*a* of the body part 111 as the nozzle 116 connected to the linear actuator 113 moves forward by a maximum amount of distance together the linear actuator 113.

Since the read portion 117*c* of the nozzle head 117 disposed at the jetting exit 111*a* has an inner diameter decreasing in size as the inner diameter reaches backward, water jet through the jetting exit 111*a* is guided by the shape of the rear portion 117*c* of the nozzle head 117 and is sprayed in a dispersed jet.

Such a dispersed jet of the variable-type nozzle unit 110 enables water to be equally sprayed to laundry such that the laundry is easily moist. In addition, water is sprayed in a hydration cycle such that a rinsing performance is enhanced.

Referring to FIGS. 1 and 2, the variable-type nozzle unit 110 is connected to the external water-supply source for both hot water and cold water through a water-supply valve 140. A flow path conversion valve 150 is installed between the water-supply valve 140 and the variable-type nozzle unit 110 to spray hot water and cold water selectively.

The water-supply valve 140 is implemented using a four-way valve such that the first water-supply pipe 71 connected to the water-supply valve 140 includes three water-supply lines, which are connected to the detergent container 75 to be used for bleaching, preliminary washing, and main washing, respectively, and the second water-supply pipe 73 connected to the water-supply valve 140 includes one supply line connected to the variable nozzle unit 110 to spray water directly to the laundry inside the drum 30.

Water sprayed to the laundry inside the drum 30 through the variable-type nozzle unit 110 is directly received from the external water-supply source, thereby enabling detergent-free water to be sprayed to the laundry during a rising cycle and thus improving the rinsing performance.

The water is sprayed to the laundry in the drum 30 through the variable nozzle unit 110 directly from the external water-supply source but separately from the detergent container 75. Accordingly, water supplied to the detergent container 75 is solely used to generate a high concentration of detergent bubbles, so that contamination of the laundry is efficiently removed.

In addition, the water is directly sprayed to the laundry with a high pressure, so that dirt is effectively removed.

Figure 7:
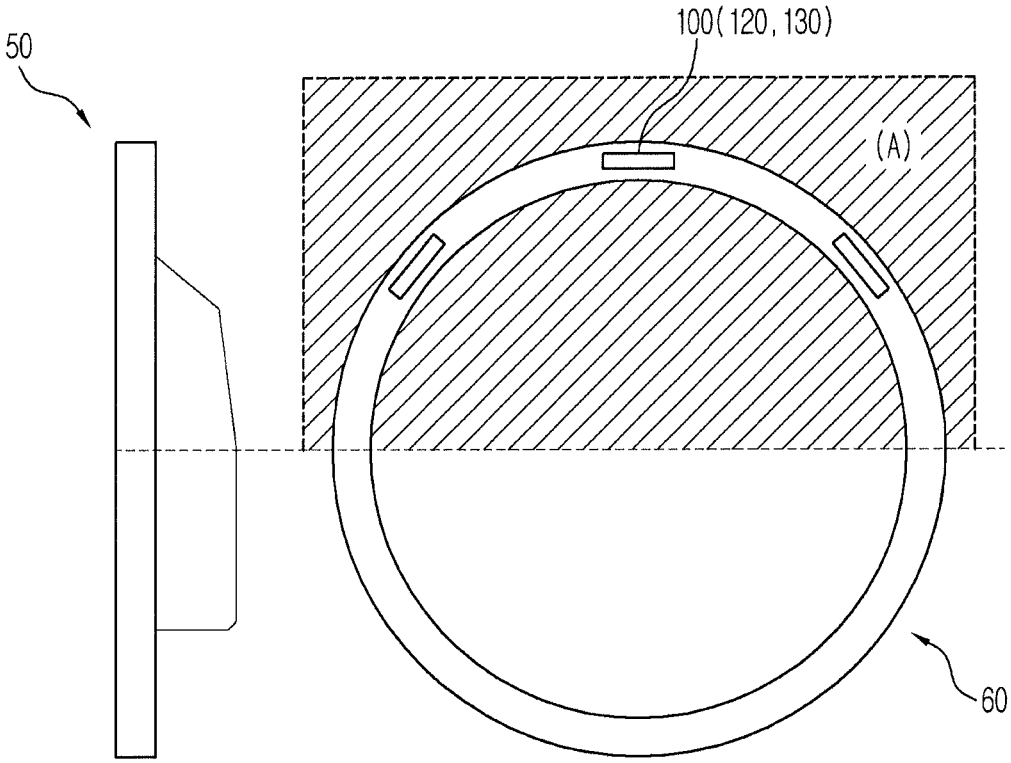
FIG. 7 is a schematic view illustrating a case in which a slit nozzle unit and an open-type orifice nozzle unit are installed on a diaphragm of the drum washing machine according to the embodiment of the present disclosure.
Figure 8:
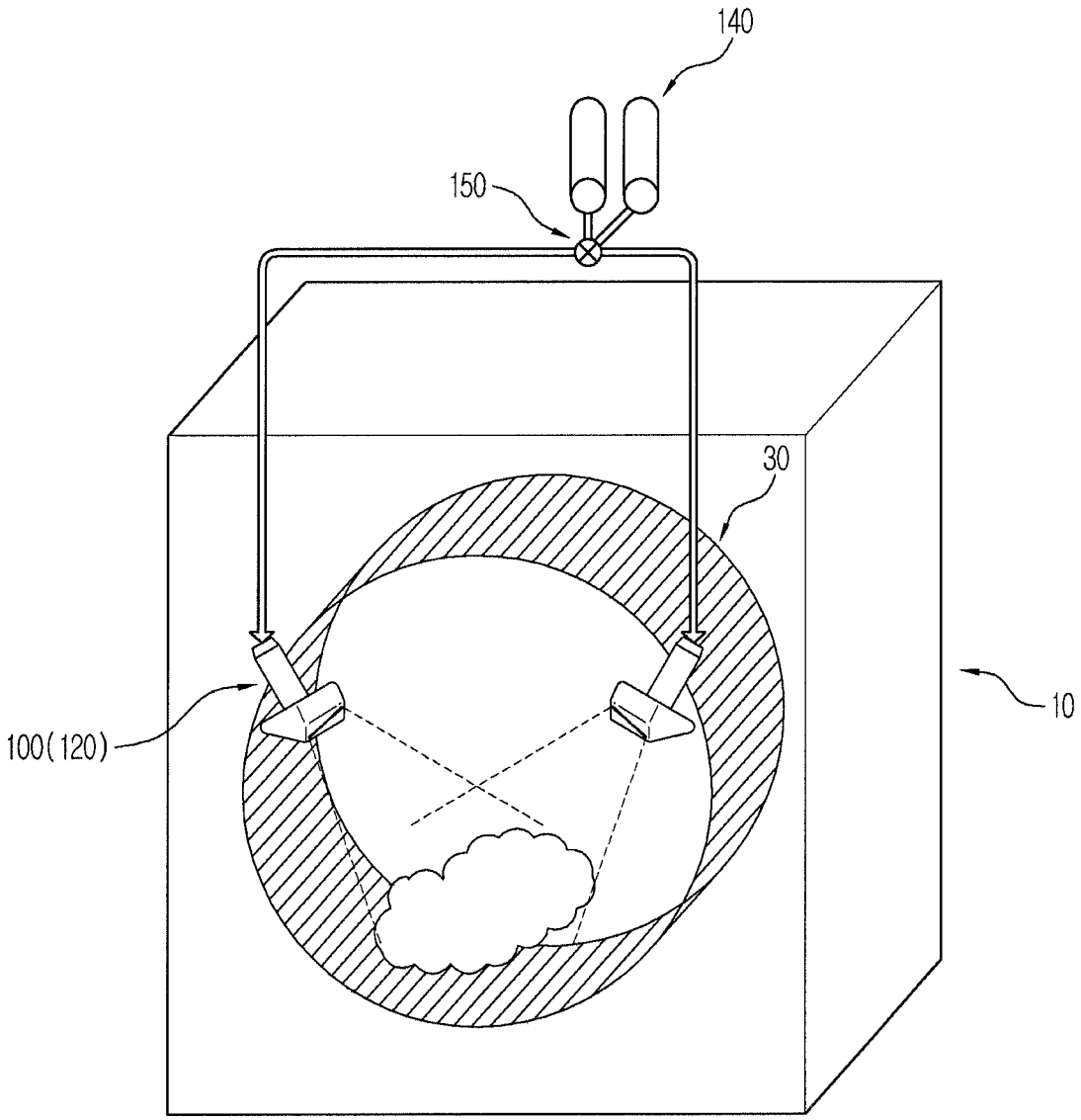
FIGS. 8 and 9 are schematic views illustrating configurations for supplying water through a slit nozzle unit of the drum washing machine according to the embodiment of the present disclosure.
Figure 9:
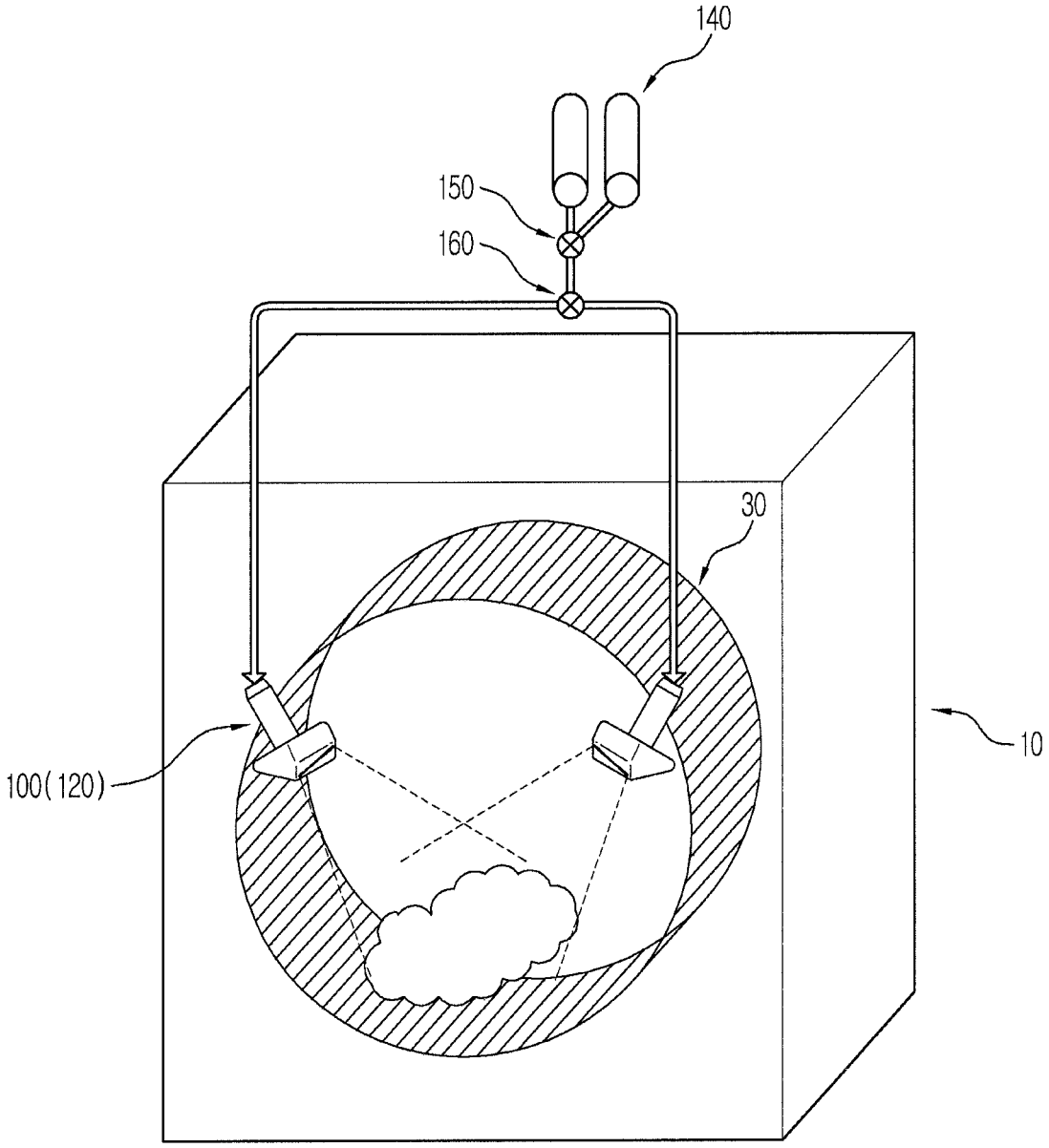

Referring to FIGS. 7 to 9, similar to the variable-type nozzle unit 110, the slit nozzle unit 120 is installed on the diaphragm 60 provided between the tub 20 and the door 50 to seal a space between the tub 20 and the door 50.

The plurality of slit nozzle units 120 is installed at an upper portion (A) of the diaphragm 60 above a middle portion of the diaphragm 60 in a tangential direction of the diaphragm 60 to avoid interference with the door 50. The slit nozzle unit 120 is configured to receive water directly from the external water-supply source, and to spray the received water to inside the drum 30.

Figure 10:
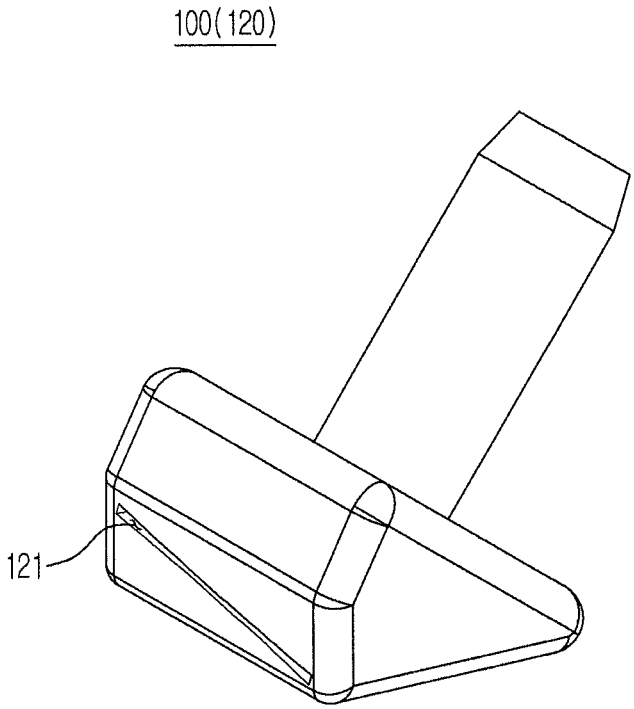
FIG. 10 is a perspective view illustrating a slit nozzle unit of the drum washing machine according to the embodiment of the present disclosure.
Figure 11:
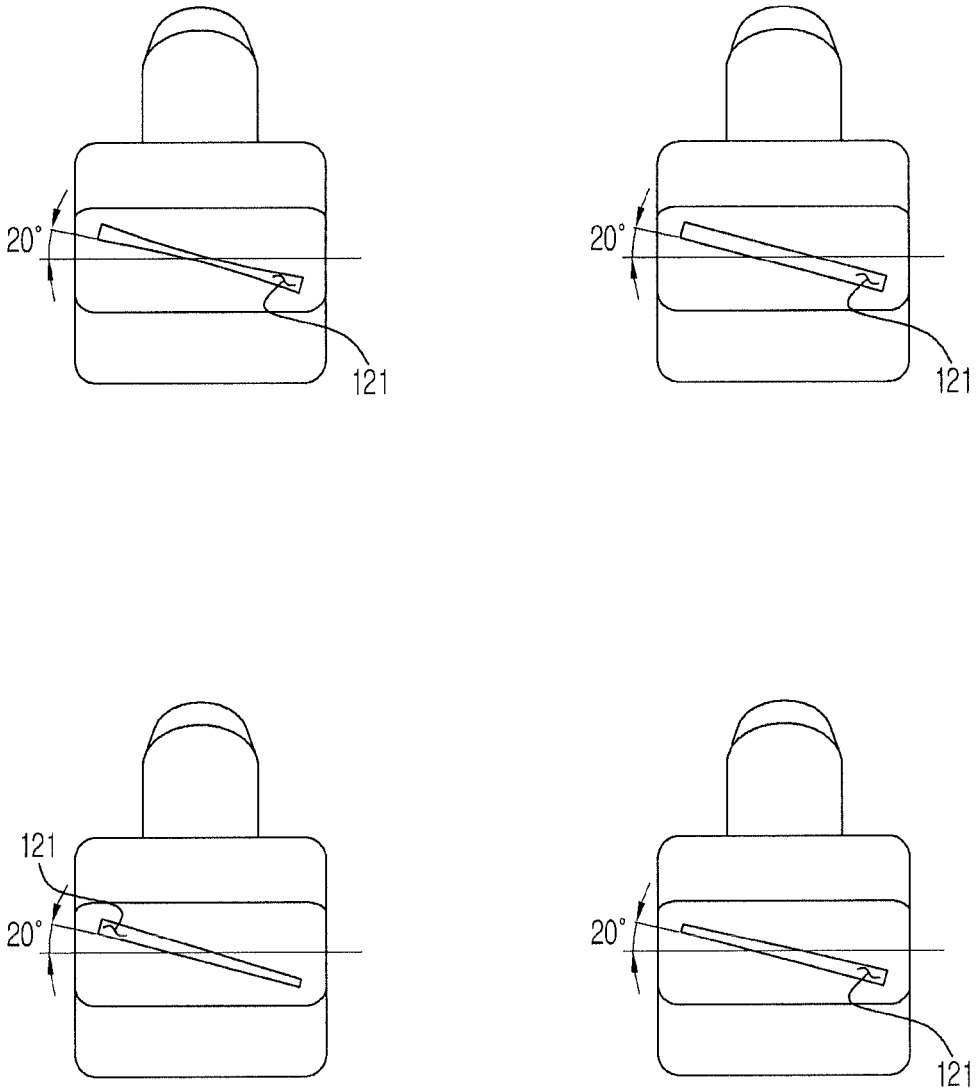
FIG. 11 is a view illustrating various shapes of jetting exits of the drum washing machine according to the embodiment of the present disclosure.

Referring to FIGS. 10 and 11, the slit nozzle unit 120 has the jetting exit 121 provided in the form of a slit. In detail, the jetting exit 121 is provided in a curved shape slit in which a middle portion of the jetting exit 121 has an interval smaller than intervals of end portions of the jetting exit 121.

The smaller interval of the middle portion of the jetting exit 121 is, the better linear jetting of water is ensured, and the farther water is sprayed with a high pressure. The larger interval of the middle portion of the jetting exit 121 is, the more water jetting is ensured.

Since the interval of the middle portion of the jetting exit 121 is smaller than those of the end portions of the jetting exit 121, the middle portion of the jetting exit 121 allows water to be sprayed a long distance with a high pressure, and the end portions of the jetting exit 121 increases the amount of sprayed water in a short distance.

The shape of the jetting exit 121 is not limited thereto. For example, the jetting exit 121 may be provided in a rectangle including a center portion having the same interval as those of end portions, or in a trapezoid including one side end having a larger interval than that of the other end side.

Figure 12:
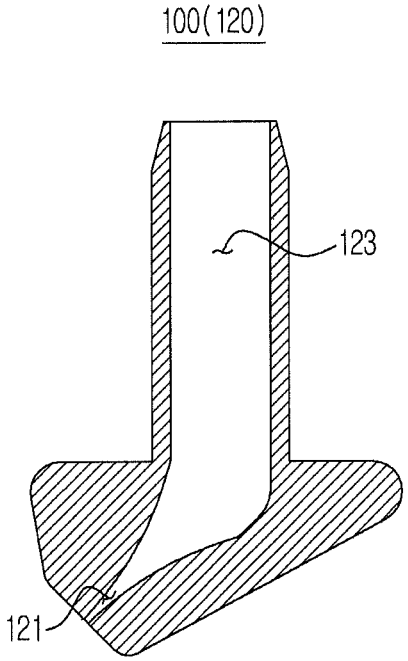
FIG. 12 is a side-sectional view illustrating a slit nozzle unit of the drum washing machine according to the embodiment of the present disclosure.

Referring to FIG. 12, in order to increase the flow rate of water supplied from the external water-supply source as the water approaches to the jetting exit an inner passage 123 of the slit nozzle unit 120 has a longitudinal size decreasing toward the jetting exit 121.

Figure 13:
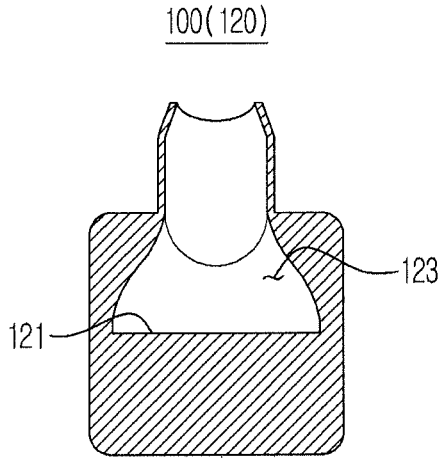
FIG. 13 is a full-sectional view illustrating a slit nozzle unit of the drum washing machine according to the embodiment of the present disclosure.

Referring to FIG. 13, in order to widely spray the water supplied through the jetting exit 121 from the external water-supply source in a dispersed jet the inner passage 123 of the slit nozzle unit 120 has a transverse size increasing toward the jetting exit 121.

Referring to FIG. 11, the jetting exit 121 is provided on the slit nozzle unit 120, which is installed on the diaphragm 60 in the tangential direction, to form an angle of ±20 degrees with respect to the slit nozzle unit 120 such that interference with the door 50 is avoided.

If the slit nozzle unit 120 is installed at an upper-right portion of the diaphragm 60, the jetting exit 121 is provided to form an angle of 20 degrees in a clockwise direction with respect to the tangential direction of the diaphragm 60 along which the slit nozzle unit 120 is installed.

Although not shown in drawings, if the slit nozzle unit 20 is installed at an upper-left portion of the diaphragm 60, the jetting exit 121 may be provided to form an angle of 20 degrees in a counter-clockwise direction with respect to the tangential direction of the diaphragm 60, Hereinafter, a jetting angle capable of avoiding interference with the door 50 when spraying water toward laundry in the drum 30 through the jetting exit 121 of the slit nozzle unit 120 is as follows.

Figure 14:
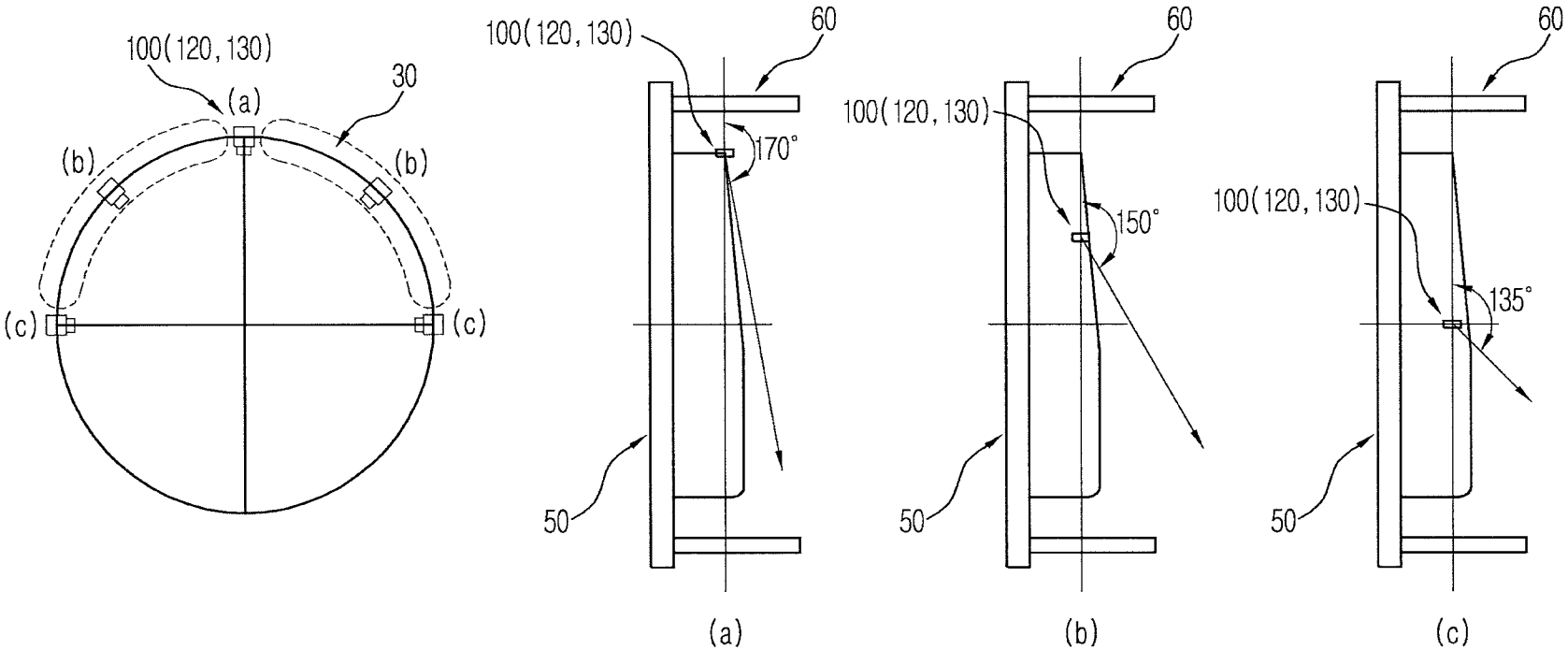
FIG. 14 is a view illustrating a jetting angle varying with a different installation position of a slit nozzle unit and an open-type orifice nozzle unit of the drum washing machine according to the embodiment of the present disclosure.

Referring to (a) of FIG. 14, if the slit nozzle unit 120 is installed at an upper-middle portion of the diaphragm 60, the slit nozzle unit 120 needs to have a jetting angle of 170 degrees or below with respect to a perpendicular line to an installation point, in which the slit nozzle unit 120 is installed, such that water is sprayed to the inside the drum 30 while interference with the door 50 is avoided.

Referring to (b) of FIG. 14, if the slit nozzle unit 120 is installed at the upper-left portion and the upper-right portion of the diaphragm 60, the slit nozzle unit 120 needs to have a jetting angle of 150 degrees or below with respect to a perpendicular line to an installation point, in which the slit nozzle unit 120 is installed, such that water is sprayed to the inside the drum 30 while interference with the door 50 is avoided.

Referring to (c) of FIG. 14, if the slit nozzle unit 120 is installed at a middle left portion and a middle right portion of the diaphragm 60, the slit nozzle unit 120 needs to have a jetting angle of 135 degrees or below with respect to a perpendicular line to an installation point, in which the slit nozzle unit 120 is installed, such that water is sprayed to the inside the drum 30 while interference with the door 50 is avoided.

Figure 15:
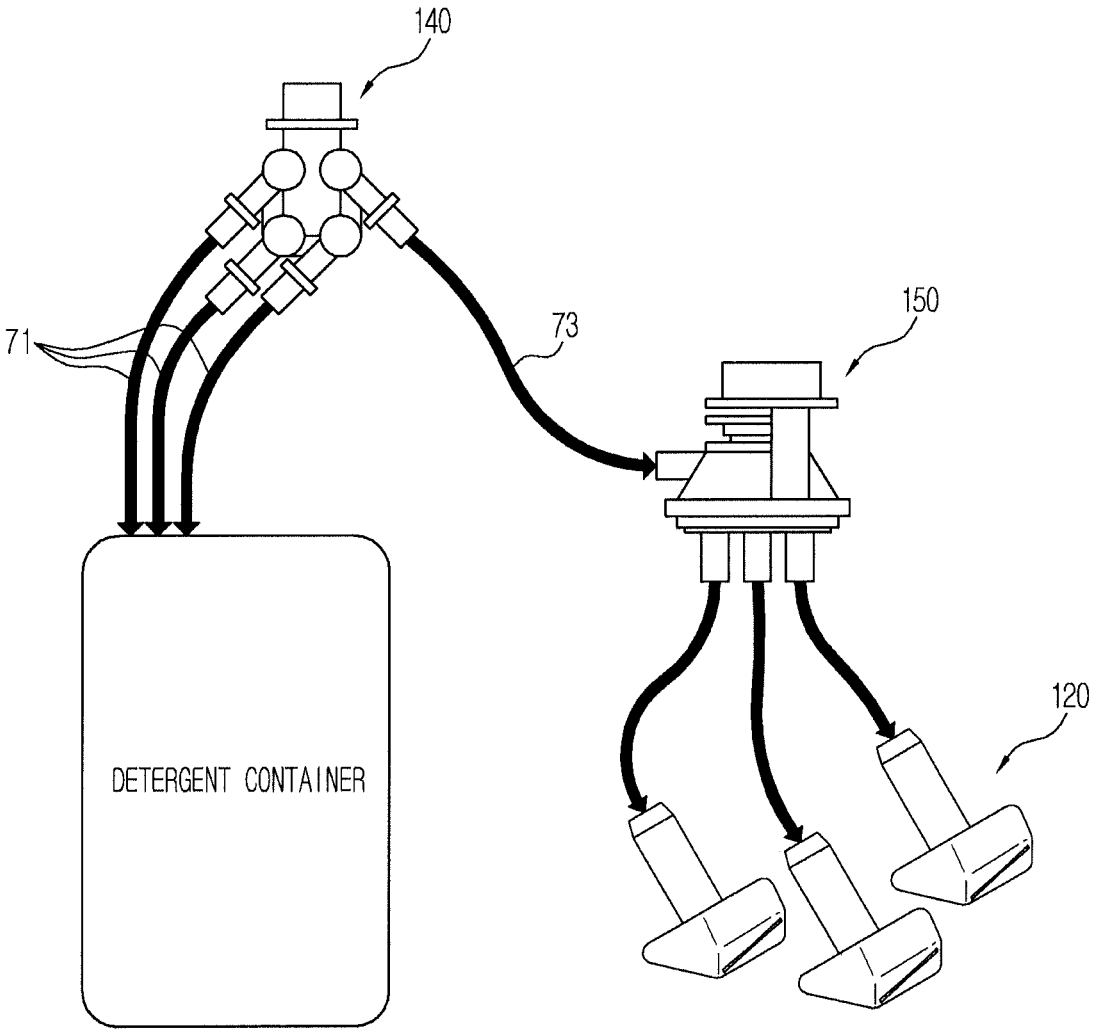
FIGS. 15 and 16 are views illustrating cases in which a slit nozzle unit is connected to a water-supply valve in the drum washing machine according to the embodiment of the present disclosure.

For the plurality of slit nozzle units 120 installed on the diaphragm 60 as shown in FIGS. 8 and 15, the slit nozzle unit 120 is connected to the external water-supply source for both hot water and cold water through the water-supply valve 140. The flow path conversion valve 150 is installed between the water-supply valve 140 and the slit nozzle unit 120 to spray hot water and cold water selectively.

The water-supply valve 140 is implemented using a four-way valve such that the first water-supply pipe 71 connected to the water-supply valve 140 includes three water-supply lines, which are connected to the detergent container 75, and the second water-supply pipe 73 connected to the water-supply valve 140 includes one supply line connected to the slit nozzle unit 120. The three water-supply lines are used for bleaching, preliminary washing, and main washing, respectively. The one water-supply line enables water to be directly sprayed to the laundry inside the drum 40 through the plurality of slit nozzle units 120.

Water sprayed to the laundry inside the drum 30 through the plurality of slit nozzle units 120 is directly received from the external water-supply source, thereby enabling detergent-free water to be sprayed to the laundry during a rising cycle and thus improving the rinsing performance.

In addition, the water is sprayed to the laundry in the drum 30 through the slit nozzle units 120 directly from the external water-supply source but separately from the detergent container 75. Accordingly, water supplied to the detergent container 75 is solely used to generate a high concentration of detergent bubbles, so that contamination of the laundry is efficiently removed. In addition, water is directly sprayed to the laundry through the plurality of slit nozzle units 120, thereby moistening and removing contamination of the laundry.

The flow path conversion valve 150 selects hot water or cold water, and provides the selected water to the plurality of slit nozzle units 120.

Figure 16:
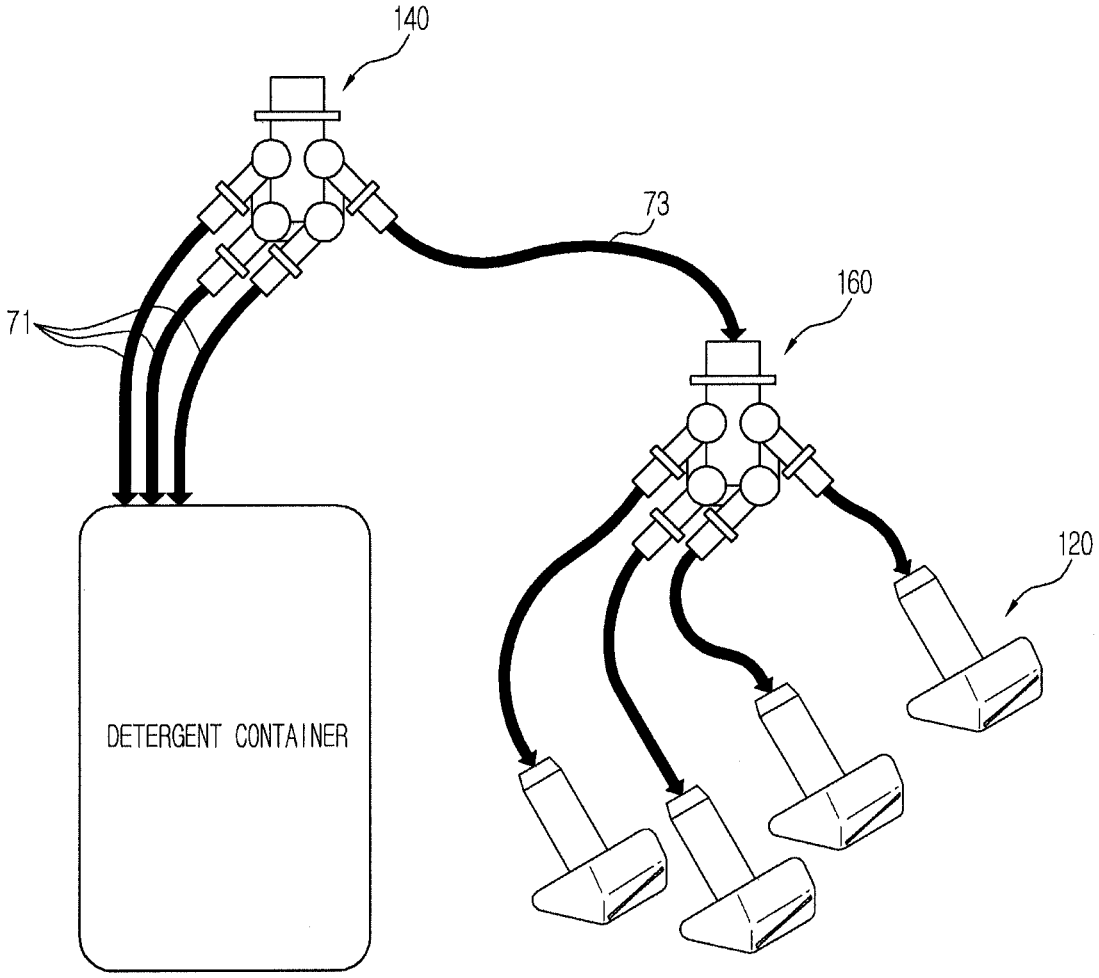

Referring to FIGS. 9 and 16, the flow path conversion valve 150 selects hot water or cold water, and an additional valve 160 provides the selected water to the slit nozzle units 120.

The additional valve 160 is shown as a four-way valve in the drawings. Alternatively, the additional valve 160 may be implemented using a valve having passages each corresponding to the plurality of slit nozzle units 120.

For the plurality of slit nozzle units 120, the direction of jetting water is adjusted according to the rotation direction of the drum 30 to reduce energy consumption. In addition, an additional physical force is applied to the laundry to enhance the washing efficiency and the rinsing efficiency.

Figure 17:
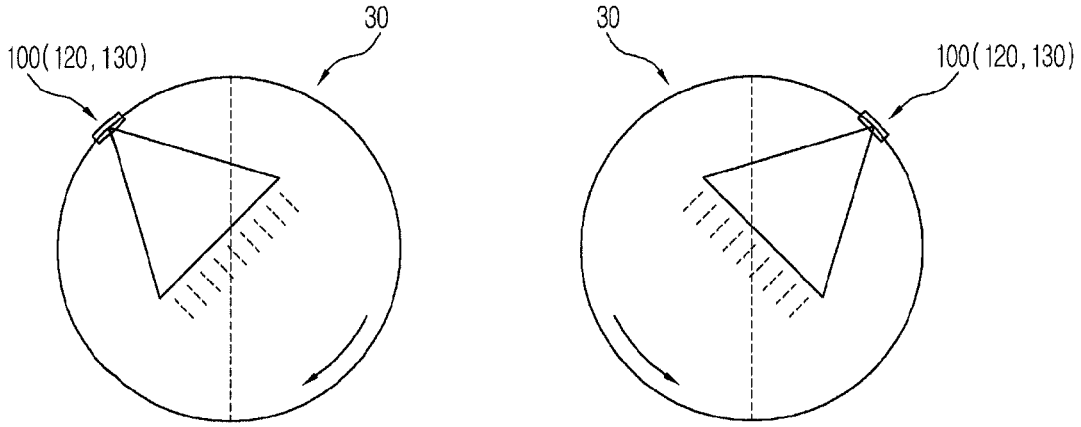
FIGS. 17 and 18 are views illustrating a slit nozzle unit and an open-type orifice nozzle unit that are operated with the rotation direction of a drum the drum washing machine according to the embodiment of the present disclosure.

Referring to the drawing on the left in FIG. 17, if the drum 30 rotates in a counter-clockwise direction, water is sprayed through the slit nozzle unit 120 installed at the upper-left portion of the diaphragm 60 among the plurality of slit nozzle units 120, and if the drum 30 rotates in a clockwise direction, water is sprayed through the slit nozzle unit 120 installed at the upper-right portion of the diaphragm 60 among the plurality of slit nozzle units 120. In this manner, water is sprayed to a falling section of the laundry inside the drum 30, so that the load of the motor 40 is minimized and energy consumption is reduced.

Figure 18:
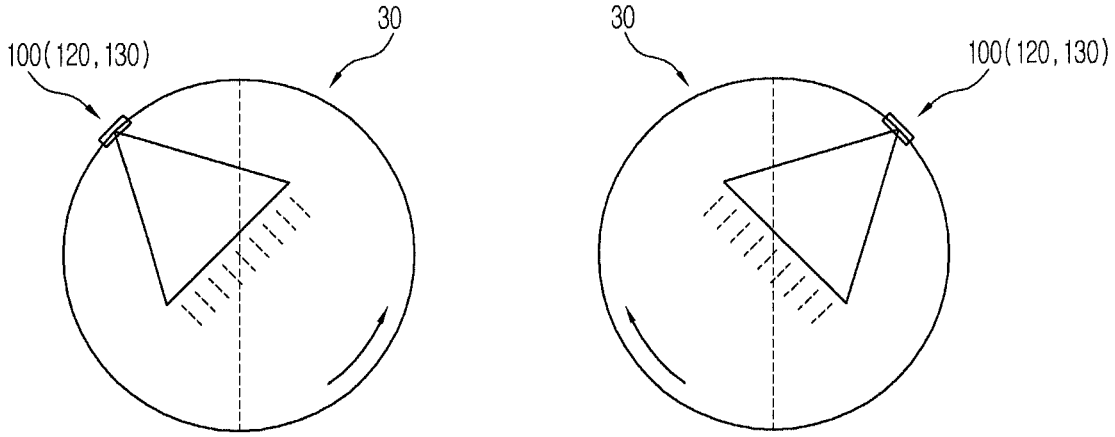

Referring to FIG. 18, if the drum 30 rotates in a counter-clockwise direction, water is sprayed through the slit nozzle unit 120 installed at the upper-right portion of the diaphragm 60 among the plurality of slit nozzle units 120, and if the drum 30 rotates in a clockwise direction, water is sprayed through the slit nozzle unit 120 installed at the upper-left portion of the diaphragm 60 among the plurality of slit nozzle units 120. In this manner, water is sprayed to a rising section of the laundry inside the drum 30, so that additional physical force is applied to the laundry, and a washing cycle and a rinsing cycle is efficiently performed.

Similar to the installation of the variable nozzle unit 110, the open-type orifice nozzle unit 130 is also installed on the diaphragm 60 configured to provided between the tub 20 and the door 50 to seal the space between the tub 20 and the door.

A plurality of open-type orifice nozzle units 130 is installed at the upper portion (A) of the diaphragm 60 above the middle portion of the diaphragm 60 in a tangential direction of the diaphragm 60 to avoid interference with the door 50. The open-type orifice nozzle unit 130 is configured to receive water directly from the external water-supply source, and to spray the received to inside the drum 30.

Figure 19:
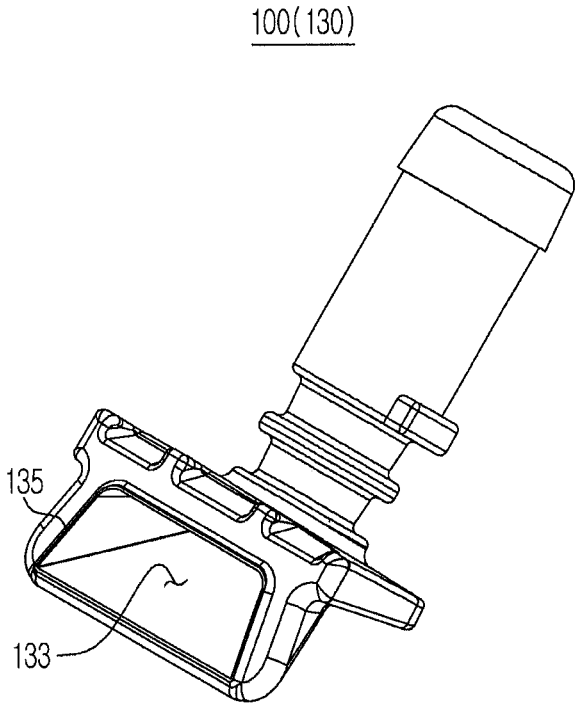
FIG. 19 is a perspective view illustrating an open-type orifice nozzle unit of the drum washing machine according to the embodiment of the present disclosure.
Figure 20:
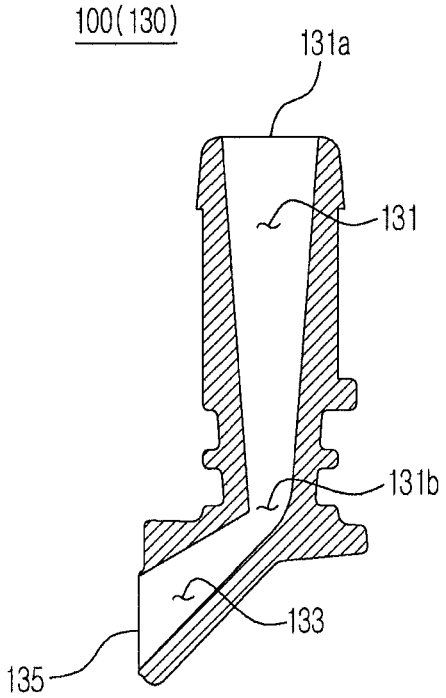
FIG. 20 is a side-sectional view illustrating an open-type orifice nozzle unit of the drum washing machine according to the embodiment of the present disclosure.

Referring to FIGS. 19 and 20, the open-type orifice nozzle unit 130 includes a first passage 131 to receive water and a second passage 133, which is connected to the first passage 131 and allows water passing through the first passage 131, to be sprayed through a jetting exit 135.

The first passage 131 includes an inlet 131*a* to receive water, and an outlet 131*b* connected to the second passage 133. The first passage 131 has an inner diameter decreasing in size from the inlet 131*a* of the first passage 131 to the outlet 131*b* of the first passage 131.

Since the first passage 131 has an inner diameter decreasing in size from the inlet 131*a* of the first passage 131 to the outlet 131*b* of the first passage 131, the flow rate of water is reduced while passing through the first passage 131.

The second passage 133 is formed by bending the first passage 131 such that water passing through the first passage 131 collides with the second passage 133 and thus widely sprayed in a dispersed jet.

In order that water is widely sprayed through the jetting exit 135 by passing through the second passage 133, the second passage 133 has an inner diameter increasing in size from a connection part with the first passage 131 to the jetting exit 135.

Hereinafter, a jetting angle capable of avoiding interference with the door 50 when spraying water toward laundry in the drum 30 through the jetting exit 135 of the open-type orifice nozzle unit 130 is as follows.

Referring to (a) of FIG. 14, if the open-type orifice nozzle unit 130 is installed at the upper-middle portion of the diaphragm 60, the open-type orifice nozzle unit 130 needs to have a jetting angle of 170 degrees or below with respect to a perpendicular line to an installation point, in which the open-type orifice nozzle unit 130 is installed, such that water is sprayed to the inside the drum 30 while interference with the door 50 is avoided.

Referring to (b) of FIG. 14, if the open-type orifice nozzle unit 130 is installed at the upper-left portion and the upper-right portion of the diaphragm 60, the open-type orifice nozzle unit 130 needs to have a jetting angle of 150 degrees or below with respect to a perpendicular line to an installation point, in which the open-type orifice nozzle unit 130 is installed, such that water is sprayed to the inside the drum 30 while interference with the door 50 is avoided.

Referring to (c) of FIG. 14, if the open-type orifice nozzle unit 130 is installed at a middle left portion and a middle right portion of the diaphragm 60, the open-type orifice nozzle unit 130 needs to have a jetting angle of 135 degrees or below with respect to a perpendicular line to an installation point, in which the open-type orifice nozzle unit 130 is installed, such that water is sprayed to the inside the drum 30 while interference with the door 50 is avoided.

Figure 21:
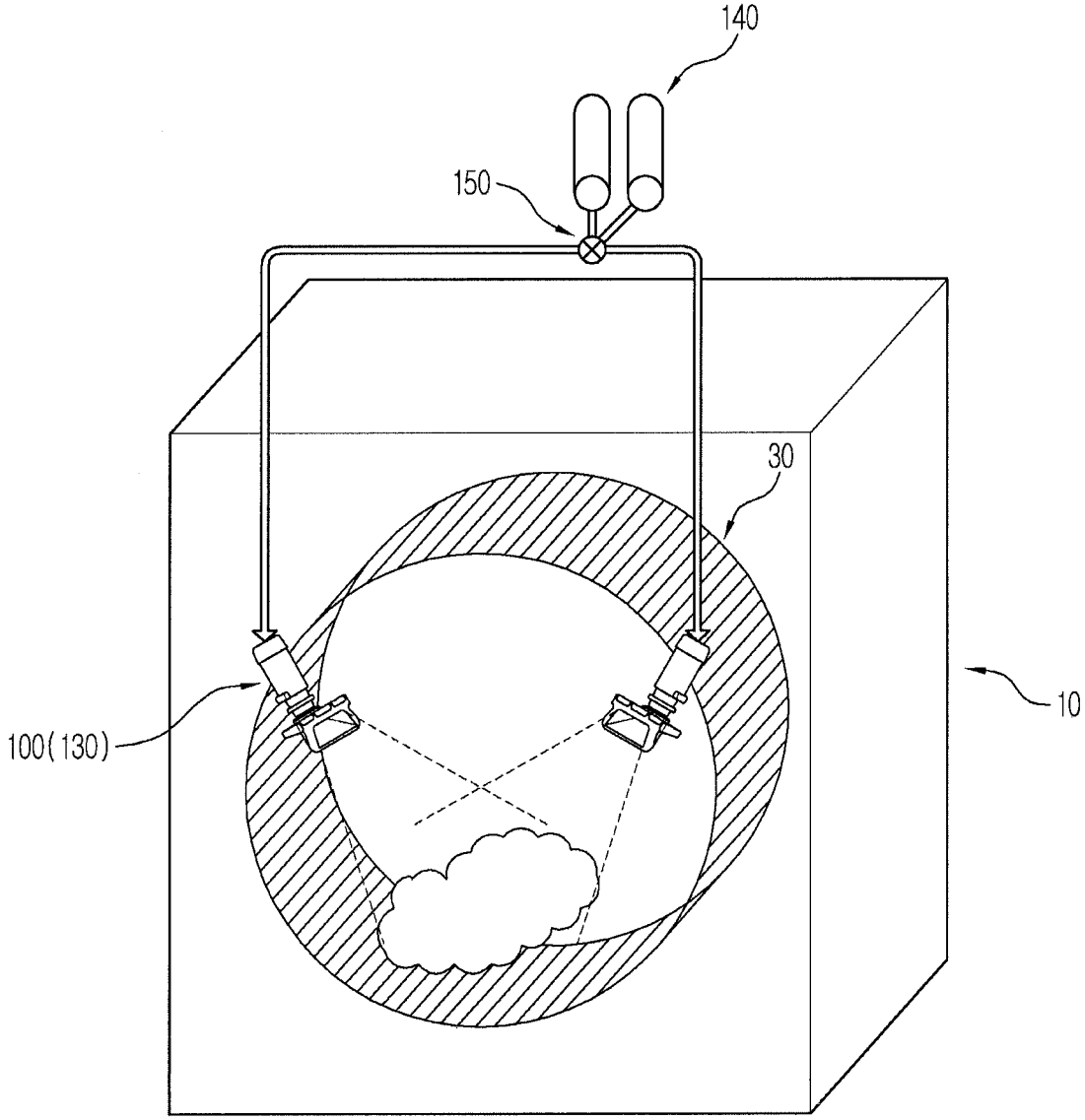
FIGS. 21 and 23 are schematic views illustrating the configuration in which water is supplied through an open-type orifice nozzle unit of the drum washing machine according to the embodiment of the present disclosure.

Referring to FIG. 21, for the plurality of open-type orifice nozzle units 130 installed on the diaphragm 60 as shown in FIG. 21, the open-type orifice nozzle units 130 is connected to the external water-supply source for both hot water and cold water through the water-supply valve 140. The flow path conversion valve 150 is installed between the water-supply valve 140, and the open-type orifice nozzle units 130 to spray hot water and cold water selectively.

Figure 22:
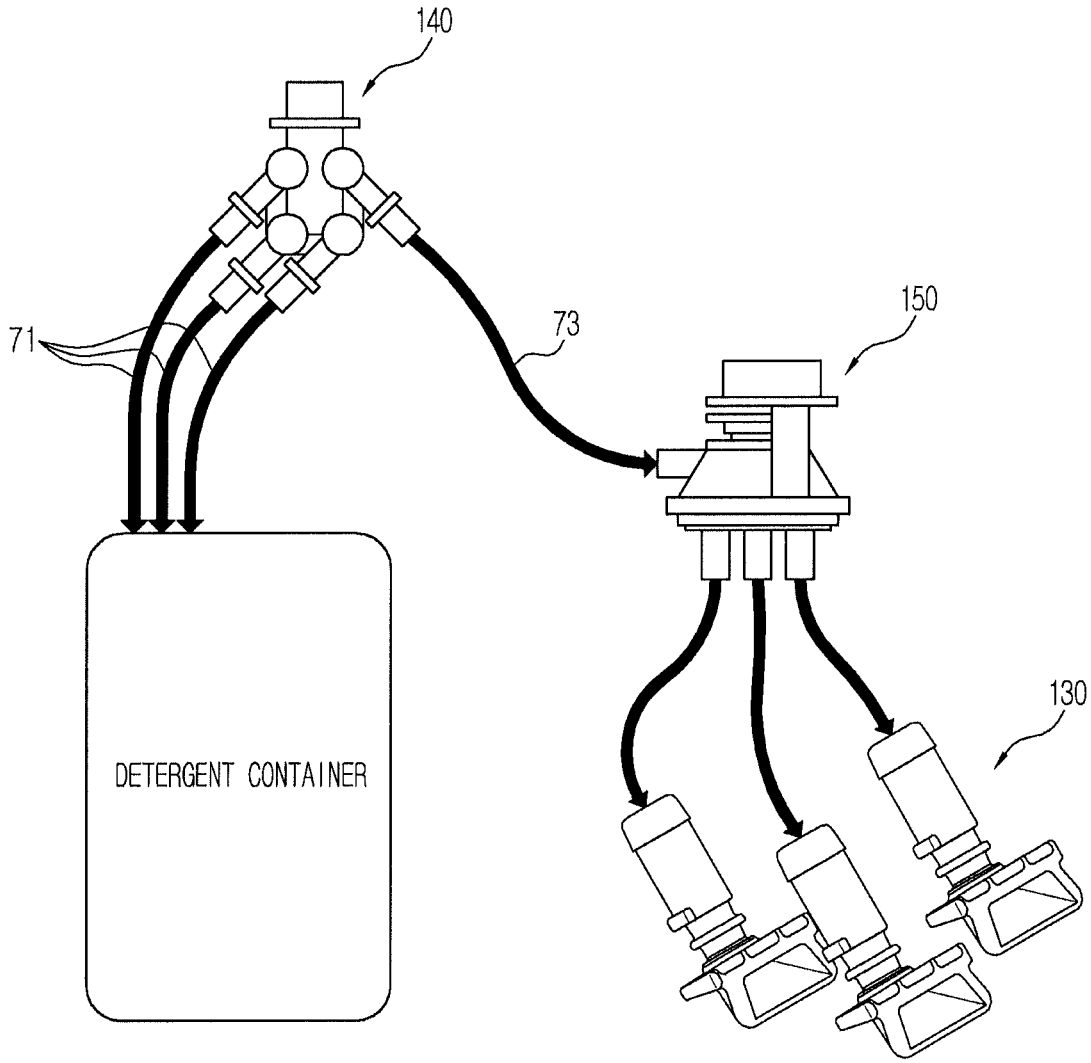
FIGS. 22 and 24 are views illustrating cases in which an open-type orifice nozzle unit is connected to a water-supply valve of the drum washing machine according to the embodiment of the present disclosure.

Referring to FIG. 22, the water-supply valve 140 is implemented using a four-way valve such that the first water-supply pipe 71 connected to the water-supply valve 140 includes three water-supply lines, which are connected to the detergent container 75, and the second water-supply pipe 73 connected to the water-supply valve 140 includes one supply line connected to the open-type orifice nozzle units 130. The three water-supply lines are used for bleaching, preliminary washing, and main washing, respectively. The one water-supply line enables water to be directly sprayed to the laundry inside the drum 40 through the plurality of open-type orifice nozzle units 130.

Water sprayed to the laundry inside the drum 30 through the plurality of open-type orifice nozzle units 130 is received directly from the external water-supply source, thereby enabling detergent-free water to be sprayed to the laundry during a rising cycle and thus improving the rinsing performance.

In addition, the water is sprayed to the laundry in the drum 30 through open-type orifice nozzle units 130 directly from the external water-supply source but separately from the detergent container 75. Accordingly, water supplied to the detergent container 75 is solely used to generate a high concentration of detergent bubbles, so that contamination of the laundry is efficiently removed. In addition, water is directly sprayed to the laundry through the plurality of open-type orifice nozzle units 130, thereby moistening and removing contamination of the laundry.

Figure 23:
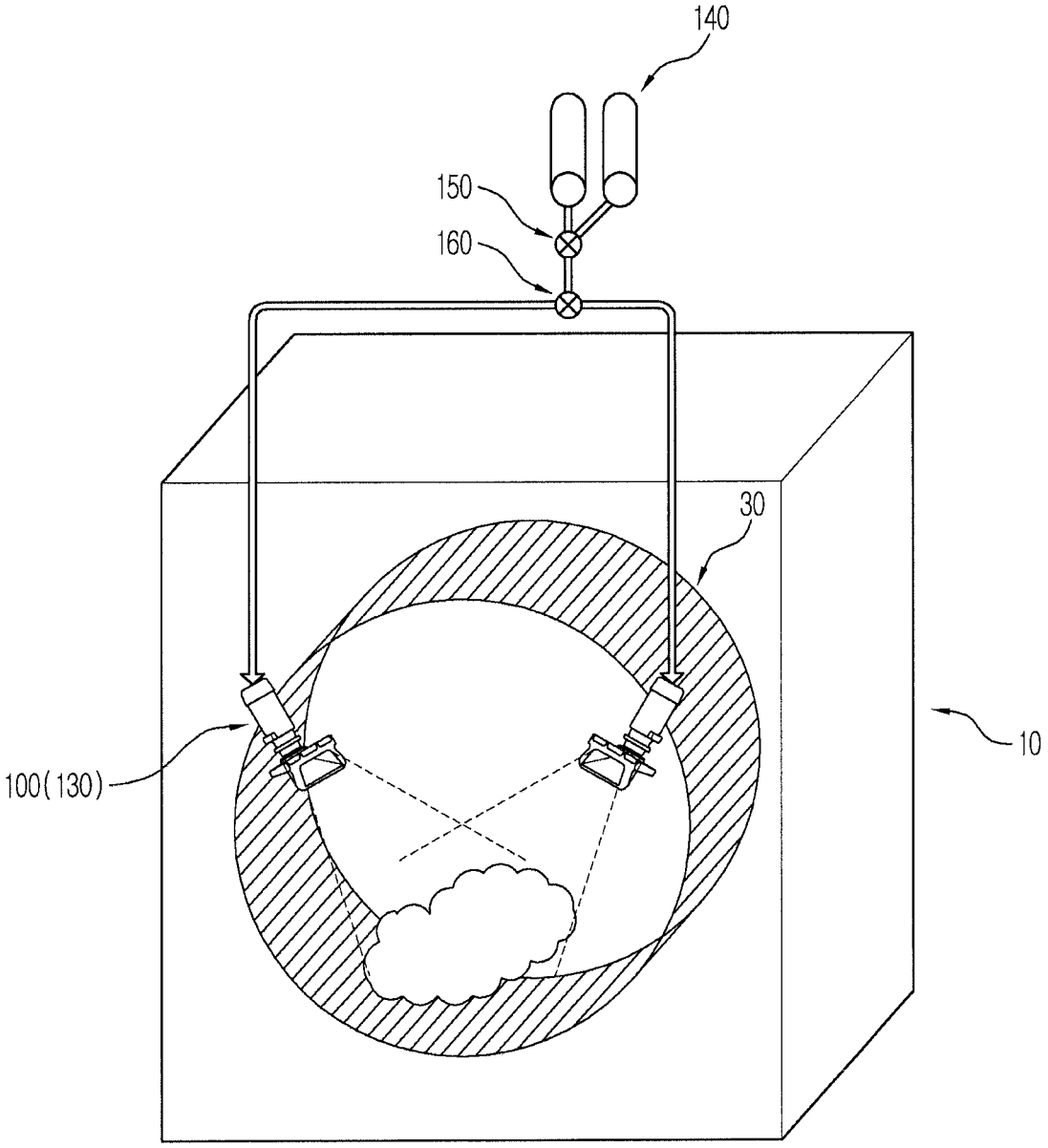
Figure 24:
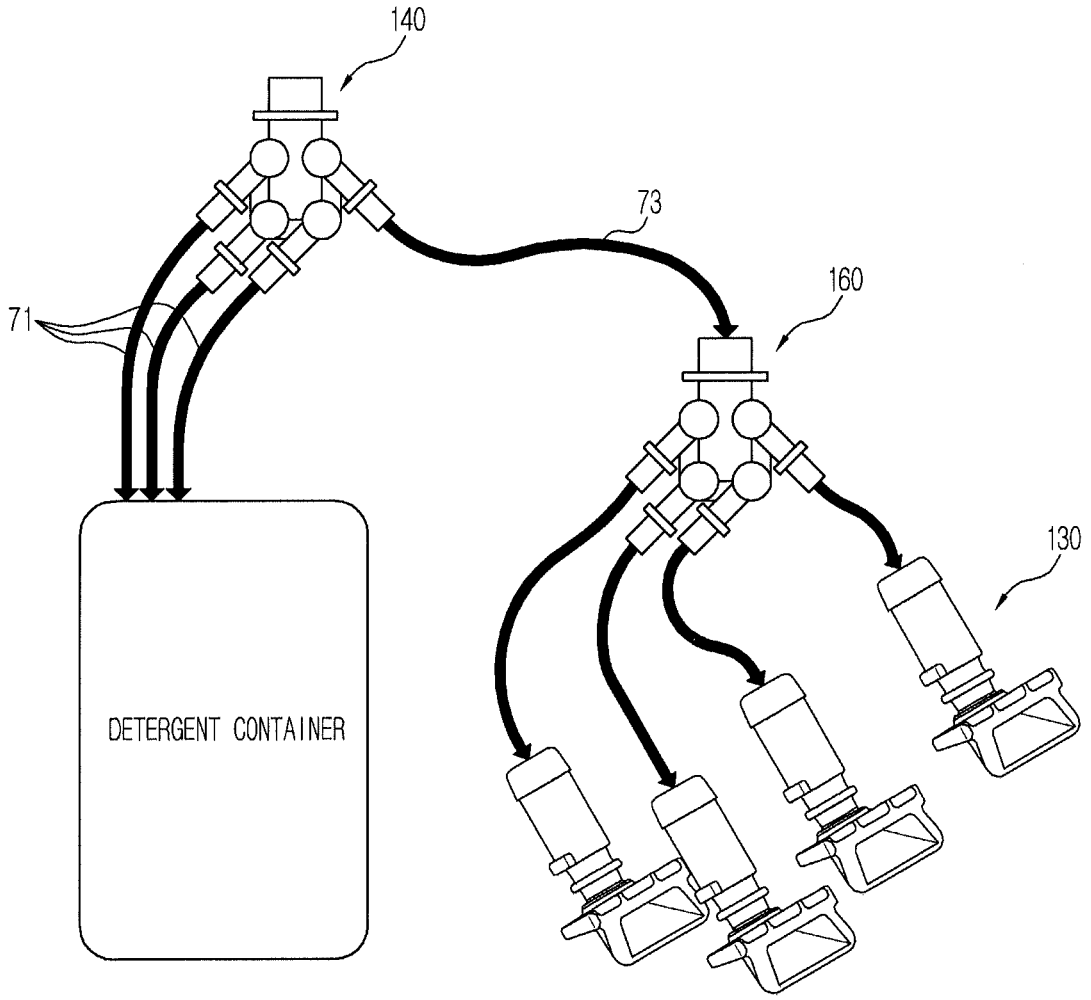
Figure 25:
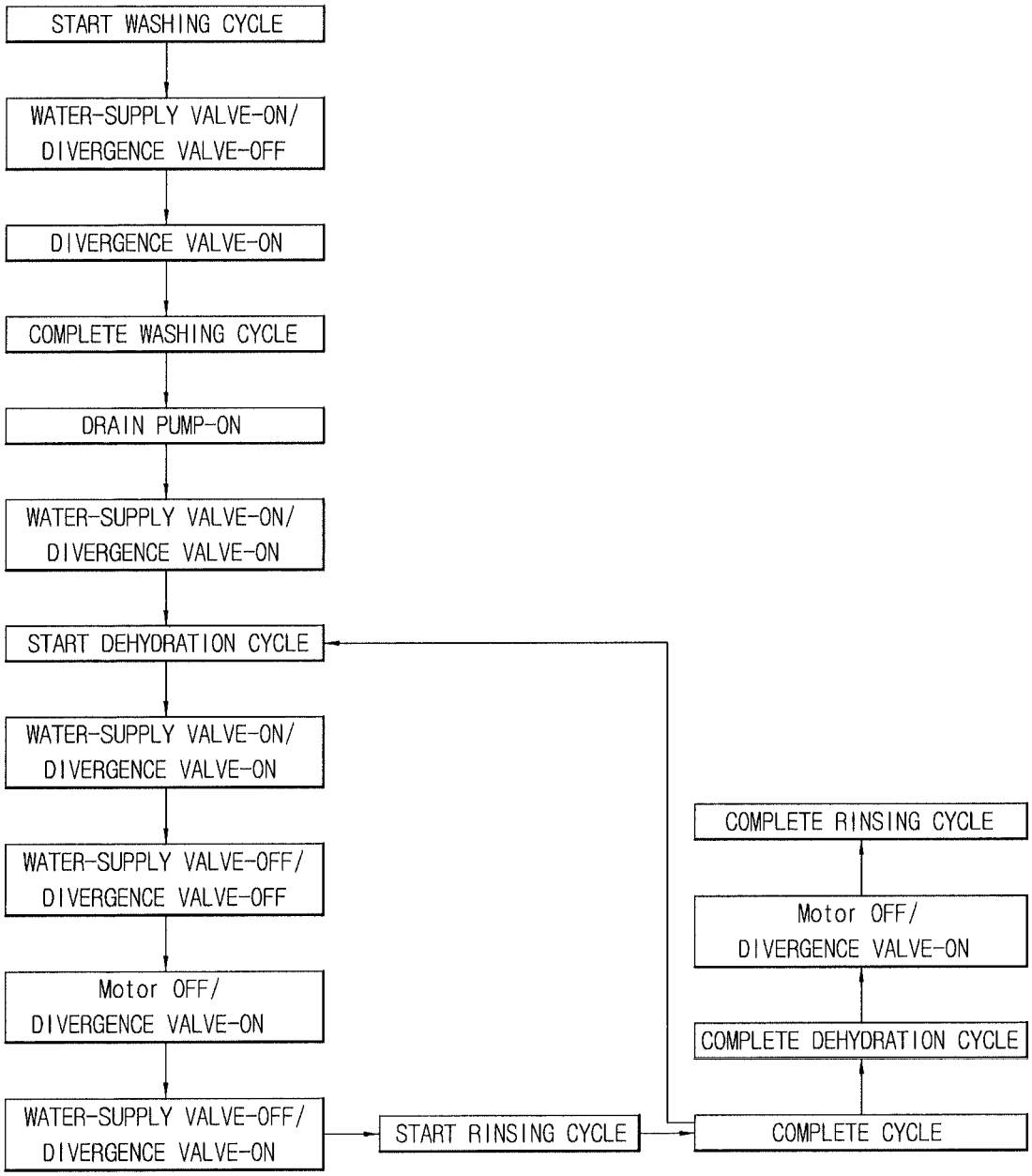
FIG. 25 is a block diagram showing a washing method according to an embodiment of the present disclosure.

The flow path conversion valve 150 selects hot water or cold water, and provides the selected water to the plurality of open-type orifice nozzle units 130. Referring to FIGS. 23 and 24, the flow path conversion valve 150 selects hot water or cold water, and an additional valve 160 provides the selected water to the open-type orifice nozzle units 130.

The additional valve 160 is shown as a four-way valve in the drawings. Alternatively, the additional valve 160 may be implemented using a valve having passages each corresponding to the plurality of open-type orifice nozzle units 130.

For the plurality of the open-type orifice nozzle units 130, the direction of jetting water is adjusted according to the rotation direction of the drum 30 to reduce energy consumption. In addition, an additional physical force is applied to the laundry to enhance the washing efficiency and the rinsing efficiency.

Referring to the drawing on the left in FIG. 17, if the drum 30 rotates in a counter-clockwise direction, water is sprayed through the open-type orifice nozzle unit 130 installed at the upper-left portion of the diaphragm 60 among the plurality of open-type orifice nozzle units 130, and if the drum 30 rotates in a clockwise direction, water is sprayed through the open-type orifice nozzle unit 130 installed at the upper-right portion of the diaphragm 60 among the plurality of open-type orifice nozzle units 130. In this manner, water is sprayed to a falling section of the laundry inside the drum 30, so that the load of the motor 40 is minimized and energy consumption is reduced.

Referring to FIG. 18, if the drum 30 rotates in a counter-clockwise direction, water is sprayed through the open-type orifice nozzle unit 130 installed at the upper-right portion of the diaphragm 60 among the plurality of open-type orifice nozzle units 130, and if the drum 30 rotates in a clockwise direction, water is sprayed through the open-type orifice nozzle unit 130 installed at the upper-left portion of the diaphragm 60 among the plurality of open-type orifice nozzle units 130. In this manner, water is sprayed to a rising section of the laundry inside the drum 30, so that additional physical force is applied to the laundry and a washing cycle and a rinsing cycle is efficiently performed.

Hereinafter, referring to FIGS. 1 to 25, a washing method of a drum washing machine will be described.

The washing method of a drum washing machine is as follows.

Water is supplied through the water-supply valve 140 connected to the external water-supply source. A divergence valve (not shown) installed on the water-supply valve 140 is switched either on or off such that the water supplied through the water-supply valve 140 is supplied to inside the drum 30 via the detergent container 75 or is sprayed inside the drum 30 through the nozzle unit.

In the beginning of a washing cycle, the water-supply valve 140 is switched on, and the divergence valve is switched off to supply water only to the detergent container 75 such that water passing through the detergent container 75 is supplied to the inside the drum and thus generates a high concentration of detergent bubbles.

If a high concentration of detergent bubbles is generated in the drum 30, the divergence valve is switched on such that water is directly sprayed to laundry inside the drum 30 through the nozzle unit 100.

If the washing cycle, is completed, a drain pump 81 is turned on to drain water from inside the drum 30, and the water-supply valve 140 and the divergence valve are switched on to spray water to the laundry through the nozzle unit 100, thereby increasing a rinsing power while draining water inside the drum If the water inside the drum 30 is drained, the water-supply valve 140 is switched off. Then, the water-supply valve 140 and the divergence valve are switched on to spray water the laundry through the nozzle unit 100 such that a rinsing power is increased while performing a hydration cycle.

In order to complete the dehydration cycle, the motor 40, which is configured to rotate the drum 30, is turned off. In a surplus power rotation range of the drum 30 occurring after the turning off of the motor 40, the water-supply valve 140 and the divergence valve are switched on to spray water to the laundry inside the drum 30, thereby increasing the rinsing power.

If the dehydration cycle is completed, the drain pump 81 is turned on to drain waste water of the drum 30 such that a rinsing cycle is performed.

Thereafter, in performing the rinsing cycle, the water-supply valve 140, and the divergence valve are turned on to spray water to the laundry through the nozzle unit 100.

When water is sprayed to the laundry the nozzle unit 100, the plurality of nozzle units 100 may be configured to sequentially spray water to the laundry.

If the rinsing cycle is completed, a hydration cycle and a rinsing cycle are alternately performed such that a laundry washing is completed with a final hydration cycle.

Before the drum 30 stops rotating in the final dehydration cycle, the divergence valve is repeatedly switched on and then off while switching on the water-supply valve 140 to adjust the amount of a jet of water passing through the nozzle unit 100, thereby cleaning the door 50.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A drum washing machine comprising:

a cabinet forming an external appearance;

a tub provided inside the cabinet to accommodate to washing water;

a drum rotatably installed inside the tub;

a door installed on the cabinet to open and close an opening formed in the tub;

a diaphragm installed between the tub and the door to seal a space between the tub and the door; and a nozzle unit installed at an upper portion of the diaphragm such that interference with the door is avoided and configured to receive water directly from an external water-supply source, which is provided outside the cabinet, and to spray water to inside the drum during a washing cycle and a rinsing cycle, wherein the nozzle unit is a variable-type nozzle unit that can adjust a water jetting type of the nozzle unit according to a displacement of a linear actuator that is installed inside the nozzle unit and moves back and forth, wherein the variable-type nozzle unit includes a body part, which is provided on a front surface thereof with a jetting exit to spray water, and a nozzle which is installed on a front surface of the linear actuator and moves back and forth by the linear actuator, and a nozzle head formed on a front surface of the nozzle partially protrudes beyond the jetting exit, and includes a front portion at the jetting exit having an inner diameter that decreases forward such that water jet through the jetting exit is guided by the shape of the front portion of the nozzle head and is sprayed toward a center of the drum washing machine in a concentrated jet.

2. The drum washing machine of claim 1, wherein the variable-type nozzle unit is installed at an upper-middle portion of the diaphragm and adjusts the water jetting type according to an operation time of the linear actuator.

3. The drum washing machine of claim 1, wherein the variable-type nozzle unit further includes a water-supply pipe connection part connected to the body part to receive water directly from the external water-supply source, a spring installed inside the body part to apply an elastic force to the linear actuator, which has moved forward, such that the linear actuator move backward, and an O-ring which is installed inside the body part to prevent leakage of water supplied through the water-supply pipe connection part.

4. The drum washing machine of claim 3, wherein the nozzle head comprises a cylindrical middle portion, a front portion, which extends from a front end of the cylindrical middle portion and has an inner diameter decreasing in size as the inner diameter reaches forward, and a rear portion, which extends from a rear end of the cylindrical middle portion and has an inner diameter decreasing in size as the inner diameter reaches backward.

5. The drum washing machine of claim 4, wherein when the linear actuator is in a non-operation state, the front portion of the nozzle head is disposed at the jetting exit such that water, which is jet through the jetting exit, is guided by a shape of the front portion and is sprayed toward a center of the drum washing machine in a concentrated jet.

6. The drum washing machine of claim 5, wherein the concentrated jet of The variable-type nozzle unit enables water to be directly sprayed to laundry inside the drum with a high pressure such that dirt is easily removed from the laundry.

7. The drum washing machine of claim 4, wherein when the linear actuator moves forward by a small amount of distance, the cylindrical middle portion of the nozzle head is disposed at the jetting exit such that water, which is jet through the jetting exit, is guided by a shape of the cylindrical middle portion and is sprayed in a horizontal jet.

8. The drum washing machine of claim 7, wherein the horizontal jet of the variable-type nozzle unit enables water to be sprayed laundry inside the drum such that moistening is easily performed and enables a physical force to be applied to the laundry such that dirt is easily removed from the laundry.

9. The drum washing machine of claim 4, wherein when the linear actuator moves forward by a maximum amount of distance, the rear portion of the nozzle head is disposed at the jetting exit such that water, which is jet through the jetting exit, is guided by a shape of the rear portion and is sprayed in a dispersed jet.

10. The drum washing machine of claim 9, wherein the dispersed jet of the variable-type nozzle unit enables laundry inside the drum to be easily moist and enables water to be sprayed to the laundry inside the drum in a dehydration cycle such that a rinsing performance for the laundry is enhanced.

11. The drum washing machine of claim 1, wherein the variable-type nozzle unit is connected to the external water-supply source for both hot water and cold water through a water-supply valve and wherein a flow path conversion valve is installed between the water-supply valve and the variable-type nozzle unit to spray hot water and cold water selectively.

12. The drum washing machine of claim 11, wherein the water-supply valve is implemented using a four-way valve such that a first water-supply pipe connected to the water-supply valve comprises three water-supply lines, which are connected to a detergent container to be used for bleaching, preliminary washing, and main washing, respectively, and a second water-supply pipe connected to the water-supply valve comprises one supply line connected to the variable nozzle unit.

* * * * *